US007024795B2

(12) United States Patent
Tadano et al.

(10) Patent No.: US 7,024,795 B2
(45) Date of Patent: Apr. 11, 2006

(54) DRYING APPARATUS

(75) Inventors: Masaya Tadano, Nitta-machi (JP); Shinichi Akiyama, Otsu (JP); Nobuo Koumoto, Otsu (JP); Toru Kawabata, Oizumi-machi (JP); Ryoko Kubo, Oizumi-machi (JP); Hiroshi Mukaiyama, Oizumi-machi (JP); Kazuyoshi Tomochika, Oizumi-machi (JP); Koji Ono, Oizumi-machi (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/911,651

(22) Filed: Aug. 5, 2004

(65) Prior Publication Data

US 2005/0044744 A1 Mar. 3, 2005

(30) Foreign Application Priority Data

Aug. 7, 2003 (JP) ..... 2003-288903
Sep. 29, 2003 (JP) ..... 2003-337620
Sep. 29, 2003 (JP) ..... 2003-337631

(51) Int. Cl.
*F26B 21/06* (2006.01)
*F26B 11/02* (2006.01)

(52) U.S. Cl. ..... 34/76; 34/73; 34/606; 34/134; 34/609; 34/499

(58) Field of Classification Search ..... 392/339; 34/73, 76, 77, 78, 606, 134, 602, 609, 608, 34/610, 318, 443, 461, 499, 582, 58
See application file for complete search history.

(56) References Cited

U.S. PATENT DOCUMENTS 3,381,113 A * 4/1968 Jacques et al. ..... 392/346
3,885,126 A * 5/1975 Sugiyama et al. ..... 392/485
4,757,183 A * 7/1988 Karey et al. ..... 392/341
6,643,953 B1 * 11/2003 Song et al. ..... 34/604

FOREIGN PATENT DOCUMENTS

DE 4212965 A1 * 10/1993
JP 11-099299 4/1999

* cited by examiner

*Primary Examiner*—Kenneth Rinehart
(74) *Attorney, Agent, or Firm*—McDermott Will & Emery LLP

(57) ABSTRACT

A drying apparatus having a purpose of shortening a drying time of laundry, comprising an accommodating chamber in which the laundry is accommodated, and executing a washing operation of the laundry and a drying operation after end of the washing operation in the accommodating chamber, the machine comprising: a refrigerant circuit in which a compressor, a gas cooler, an expansion valve, and an evaporator are successively connected to one another in an annular form via a piping; an air circulation path for discharging air which has exchanged heat with the gas cooler into the accommodating chamber by a blower to exchange the heat of the air passed through the accommodating chamber with the evaporator; and a control device for operating the compressor and the blower to perform the drying operation, wherein the control device starts the operation of the compressor before entering the drying operation.

17 Claims, 10 Drawing Sheets

DRYING APPARATUS

BACKGROUND OF THE INVENTION

The present invention relates to a drying apparatus including an accommodating chamber for accommodating things to be dried, or laundry, in which a drying operation of the things to be dried is executed, or a washing operation of the laundry and a drying operation after end of the washing operation are performed in the accommodating chamber.

In recent years, there has been provided a drying apparatus (washing/drying apparatus) for automatically performing washing to drying in an accommodating chamber in which laundry is accommodated. The drying apparatus generally performs a washing operation including a plurality of different processes such as washing, rinsing, and spin-drying, and a drying operation for drying the laundry spin-rinsed in the processes.

Here, in the drying operation, an electric heater or a gas combustion heater has heretofore been used as a heat source. After heating outside air by the electric heater or the combustion heater to obtain high-temperature air, the air is blown into the accommodating chamber in which the laundry has been accommodated to dry the laundry in the accommodating chamber. Moreover, the high-temperature air in the accommodating chamber, by which the laundry has been dried, is exhausted to the outside.

However, when the drying operation is performed using the electric heater, the gas combustion heater or the like, outside air at a low temperature outside the accommodating chamber is used in the high-temperature air blown into the accommodating chamber, and therefore a long time is required until the laundry dries. Therefore, energy consumption for drying the laundry to be dried increases, and there has been a problem that energy costs such as electricity and gas charges soar.

To solve the problem, a drying apparatus has also been developed in which a heating pump constituted of a compressor, a heating coil, a decompression device, and a cooling coil and capable of circulating a heat exchange medium is used at the time of the drying operation, the laundry is dried by the high-temperature air heated by the heating coil, and moisture evaporated from the laundry is coagulated and discarded by the cooling coil (see, for example, Japanese Patent Application Laid-Open No. 11-99299).

By use of the heating pump, it can be expected that a time required for drying the laundry is shortened and energy efficiency is raised. However, with the use of the heating pump, as compared with heater systems such as an electric heater and a combustion heater, a thermal capacity of a heating pump apparatus is large, and therefore there has been a problem that a long time is required from when the compressor is started and the heating coil warms at a predetermined high temperature until the moisture can be taken from the laundry in the accommodating chamber.

Moreover, in the conventional drying apparatus (washing/drying apparatus), laundry such as clothing accommodated in the accommodating chamber is constituted of fiber, thread or fiber falls from the clothing during the drying, and waste thread floats in drying air. The high-temperature/humidity air containing the waste thread exchanges heat with the cooling coil or the heating coil, and is discharged as the high-temperature air from which the moisture has been removed into the accommodating chamber again. In this case, there has been a problem that the waste thread floating in the high-temperature/humidity air adheres to the cooling coil or the heating coil, and an air passage for circulating the air is closed, that is, clogged. The occurrence of the clogging by the waste thread hampers normal temperature control of the cooling coil or the heating coil, and it becomes difficult to attain a purpose of smoothly performing the drying of the laundry.

To solve the problem, it is considered that a meshed filter is disposed in a circulation passage of the drying air as a method for capturing the waste thread floating in the drying air, but there has been a problem that maintenance works such as replacing and cleaning of the filter are complicated.

Moreover, generation of drying unevenness of the laundry to be dried in a rotating drum raises a problem in the drying apparatus. To solve the problem, the drum has heretofore been rotated to tumble the laundry to be dried therein for a purpose of uniformly drying the laundry to be dried, but the drying of the laundry to be dried accumulated in a place distant from discharge ports of the drying air is retarded. To solve the problem, in Patent Document 1 described above, a duct is formed in a lid member via which the laundry to be dried is taken in/out, and the drying air is discharged into the drum from the duct. However, even in this case, since a discharge direction of the drying air is limited, the drying unevenness is generated by all means.

To solve the conventional technical problems, an object of the present invention is to provide a drying apparatus capable of shortening a drying time of laundry.

Another object of the present invention is to provide a drying apparatus capable of easily capturing waste thread floating in drying air using dew condensation water of an evaporator and capable of avoiding clogging by the waste thread in a radiator, an evaporator or the like beforehand.

Still another object of the present invention is to provide a drying apparatus capable of more uniformly drying laundry to be dried accommodated in an accommodating chamber in a rotating drum.

SUMMARY OF THE INVENTION

According to the present invention, there is provided a drying apparatus comprising: an accommodating chamber in which laundry is accommodated and in which a washing operation of the laundry and a drying operation after end of the washing operation are performed; a refrigerant circuit in which a compressor, a radiator, a decompression device, and an evaporator are successively connected to one another in an annular form via a piping; an air path for discharging air which has exchanged heat with the radiator into the accommodating chamber by blower means to exchange the heat of the air passed through the accommodating chamber with the evaporator; and control means for operating the compressor and the blower means to perform the drying operation, wherein the control means starts the operation of the compressor before entering the drying operation.

Moreover, according to the present invention, there is provided a drying apparatus comprising: an accommodating chamber in which laundry is accommodated and in which a washing operation of the laundry and a drying operation after end of the washing operation are performed; a refrigerant circuit in which a compressor, a radiator, a decompression device, and an evaporator are successively connected to one another in an annular form via a piping; an air path for discharging air which has exchanged heat with the radiator into the accommodating chamber by blower means to exchange the heat of the air passed through the accommodating chamber with the evaporator; control means for operating the compressor and the blower means to perform the drying operation; an electric heater; and power accumulation means for accumulating power to be supplied to the electric heater, wherein the control means heats the air discharged into the accommodating chamber by the electric heater at the time of the drying operation.

Furthermore, according to the present invention, there is provided a drying apparatus comprising: an accommodating chamber in which laundry is accommodated and in which a washing operation of the laundry and a drying operation after end of the washing operation are performed; a refrigerant circuit in which a compressor, a radiator, a decompression device, and an evaporator are successively connected to one another in an annular form via a piping; an air path for discharging air which has exchanged heat with the radiator into the accommodating chamber by blower means to exchange the heat of the air passed through the accommodating chamber with the evaporator; control means for operating the compressor and the blower means to perform the drying operation; an electric heater; and a heat storage material heated by the electric heater to store heat, wherein the control means heats the air discharged into the accommodating chamber by the heat storage material at the time of the drying operation.

Additionally, in the drying apparatus of the present invention, the control means accumulates power into the power accumulation means in a range of a power input limitation at the time of the washing operation, or heats the heat storage material by the electric heater.

According to the present invention, the drying apparatus comprises: the accommodating chamber in which the laundry is accommodated and in which the washing operation of the laundry and the drying operation after end of the washing operation are performed; the refrigerant circuit in which the compressor, radiator, decompression device, and evaporator are successively connected to one another in the annular form via the piping; the air path for discharging the air which has exchanged the heat with the radiator into the accommodating chamber by the blower means to exchange the heat of the air passed through the accommodating chamber with the evaporator; and the control means for operating the compressor and the blower means to perform the drying operation, wherein the control means starts the operation of the compressor before entering the drying operation, so that a temperature of the radiator of the refrigerant circuit is sufficiently raised at the time when the drying operation is started, and the air discharged into the accommodating chamber can be smoothly heated. Since the temperature of the evaporator of the refrigerant circuit can also be lowered at the start of the drying operation, the moisture-containing air discharged from the accommodating chamber can be cooled and smoothly dehumidified.

Accordingly, a heating capability in the radiator and a dehumidifying capability in the evaporator at the start of the drying operation can be improved, and a drying time of the washing/drying apparatus can be shortened.

Moreover, according to the present invention, the drying apparatus comprises: the accommodating chamber in which the laundry is accommodated and in which the washing operation of the laundry and the drying operation after the end of the washing operation are performed; the refrigerant circuit in which the compressor, radiator, decompression device, and evaporator are successively connected to one another in the annular form via the piping; the air path for discharging the air which has exchanged the heat with the radiator into the accommodating chamber by the blower means to exchange the heat of the air passed through the accommodating chamber with the evaporator; the control means for operating the compressor and the blower means to perform the drying operation; the electric heater; and the power accumulation means for accumulating the power to be supplied to the electric heater, wherein the control means heats the air discharged into the accommodating chamber by the electric heater at the time of the drying operation. Therefore, the power is accumulated in the power accumulation means in a time zone other than the drying operation, so that the accumulated power can be supplied to the electric heater at the time of the drying operation to heat the air discharged into the accommodating chamber.

Accordingly, the heating capability especially for raising the temperature of the radiator at the start of the drying operation is improved, and the drying time can be shortened. When the power is accumulated into the power accumulation means using midnight power, operation costs can also be reduced.

Moreover, according to the present invention, the drying apparatus comprises: the accommodating chamber in which the laundry is accommodated and in which the washing operation of the laundry and the drying operation after the end of the washing operation are performed; the refrigerant circuit in which the compressor, radiator, decompression device, and evaporator are successively connected to one another in the annular form via the piping; the air path for discharging the air which has exchanged the heat with the radiator into the accommodating chamber by the blower means to exchange the heat of the air passed through the accommodating chamber with the evaporator; the control means for operating the compressor and the blower means to perform the drying operation; the electric heater; and the heat storage material heated by the electric heater to store the heat, wherein the control means heats the air discharged into the accommodating chamber by the heat storage material at the time of the drying operation. Therefore, the electric heater is energized to store the heat in the heat storage material in a time zone other than the drying operation, so that the air discharged into the accommodating chamber can be heated by the heat storage material at the time of the drying operation.

Accordingly, a heating capability for raising the temperature of the radiator especially at the start of the drying operation is improved, and a drying time can be shortened. When the heat storage material is heated by the electric heater using midnight power, operation costs can also be reduced.

Moreover, according to the present invention, the control means additionally accumulates the power into the power accumulation means within the range of the power input limitation, or heats the heat storage material by the electric heater at the time of the washing operation. Therefore, the power accumulation/heat storage can be performed before the drying operation is started.

Accordingly, an energy loss by discharge from the power accumulation means or radiation from the heat storage material is minimized, and an operation efficiency can be further improved. Especially when the power accumulation/heat storage is performed within the range of the power input limitation, the power accumulation/heat storage can be performed without performing any electric work separately.

According to the present invention, there is provided another drying apparatus comprising: an accommodating chamber in which laundry to be dried is accommodated and in which a drying operation of the laundry to be dried is performed; heating means; cooling means; blower means for discharging air which has exchanged heat with the heating means into the accommodating chamber to exchange the heat of the air passed through the accommodating chamber with the cooling means; and waste thread removing means for storing water for removing waste thread in the air discharged from the accommodating chamber, wherein dew condensation water attached to the cooling means is supplied to the waste thread removing means.

Moreover, the drying apparatus of the present invention further includes a refrigerant circuit in which a compressor, a radiator, a decompression device, an evaporator and the like are successively connected to one another in an annular form via a piping, the radiator constitutes the heating means, and the evaporator constitutes the cooling means.

Furthermore, in the drying apparatus of the present invention, the waste thread removing means is structured to spray the air passed through the accommodating chamber to the water to be stored.

Additionally, in the drying apparatus of the present invention, the waste thread removing means includes: a tank in which water is stored; a guide port for introducing the air passed through the accommodating chamber from an upper part of the tank; an outflow port for allowing the air to flow from the upper part of the tank; and a partition wall which is positioned between the guide port and the outflow port and which moves down to a position above and apart from the surface of the water in the tank from the upper part of the tank.

Moreover, in the drying apparatus of the present invention, the waste thread removing means includes water supply means and draining means.

Furthermore, in the drying apparatus of the present invention, the refrigerant circuit uses carbon dioxide as a refrigerant, and has a supercritical pressure on a high pressure side thereof.

In this case, according to the present invention, the drying apparatus comprises: the accommodating chamber in which the laundry to be dried is accommodated and in which the drying operation of the laundry to be dried is performed; the heating means; the cooling means; the blower means for discharging the air which has exchanged the heat with the heating means into the accommodating chamber to exchange the heat of the air passed through the accommodating chamber with the cooling means; and the waste thread removing means for storing the water for removing the waste thread in the air discharged from the accommodating chamber, wherein the dew condensation water attached to the cooling means is supplied to the waste thread removing means. The waste thread floating in the drying air can be captured by the water and removed. Accordingly, a disadvantage that the waste thread adheres to the heating means, cooling means and the like can be avoided in advance.

Especially, according to the present invention, since the waste thread in the drying air can be captured/removed without using any filter for capturing the waste thread, maintenance works such as replacing and cleaning of the filter do not have to be performed. In the meshed filter, when the waste thread is recovered during the drying operation, there are disadvantages that air resistance in the filter increases and that the drying capability is lowered. However, according to the present invention, since the clogging by the waste thread does not occur, a stable drying capability can be realized. Furthermore, since the dew condensation water of the evaporator is used in the water for removing the waste thread in the air, the water for removing the waste thread does not have to be replenished during the drying operation by supplying water once before the drying operation. Therefore, it is possible to save water charges, and maintenance can be simplified.

Moreover, according to the present invention, in the above-described invention, the drying apparatus further comprises the refrigerant circuit in which the compressor, radiator, decompression device, evaporator and the like are successively connected to one another in the annular form via the piping, the radiator constitutes the heating means, and the evaporator constitutes the cooling means. Therefore, the laundry to be dried accommodated in the accommodating chamber is heated by high-temperature air for drying heated by the radiator, and moisture evaporated from the laundry to be dried can be coagulated by the evaporator and discarded or recycled as the water for removing the waste thread.

Accordingly, a time required for the drying is effectively reduced, and an energy efficiency can be largely raised. Since the air containing a lot of moisture does not have to be discarded to the outside of the accommodating chamber by dehumidifying, an environment of a room in which the drying apparatus is installed is not deteriorated, and it is possible to eliminate an equipment cost for improving the room environment.

Moreover, according to the present invention, as described above, the waste thread removing means is structured to spray the air passed through the accommodating chamber to the water to be stored. Therefore, since the waste thread in the air is sprayed to the water and removed, the waste thread can be smoothly removed without lowering an air speed of the drying air to the utmost. Therefore, an influence of the removing of the waste thread on a drying capability can be reduced.

Furthermore, according to the present invention, as described above, the waste thread removing means includes: the tank in which water is stored; the guide port for introducing the air passed through the accommodating chamber from the upper part of the tank; the outflow port for allowing the air to flow from the upper part of the tank; and the partition wall which is positioned between the guide port and the outflow port and which moves down to the position above and apart from the surface of the water in the tank from the upper part of the tank. Therefore, it is possible to effectively remove the waste thread in a simple structure.

Additionally, according to the present invention, as described above, since the waste thread removing means includes the draining means, the captured waste thread can be discarded together with the water. Since the waste thread captured by the waste thread removing means is exhausted at a stretch together with a large amount of water by the draining means, a disadvantage that a drain ditch is clogged with the waste thread can be avoided.

Moreover, according to the present invention, as described above, since the refrigerant circuit uses carbon dioxide as the refrigerant, and has the supercritical pressure on the high pressure side, the temperature of the radiator can be raised. Accordingly, the drying air circulated in the accommodating chamber is maintained at a high temperature, the laundry to be dried which is accommodated in the accommodating chamber is dried in a shorter time, and energy consumption for use in the drying can be further saved.

According to the present invention, there is still another drying apparatus for supplying drying air into an accommodating chamber constituted in a rotating drum to perform a drying operation of laundry to be dried accommodated in the accommodating chamber, wherein discharge ports for discharging the drying air are formed on opposite sides of the rotating drum in a rotation axis direction.

Moreover, the drying apparatus of the present invention includes: a discharge port formed on one side of a rotation axis of the rotating drum; a discharge port formed on the other side; and a duct member which is disposed protruding from an inner wall of the rotating drum and which guides drying air to the discharge port on the other side from one side of the rotation axis of the rotating drum.

Furthermore, in the drying apparatus of the present invention, the discharge ports are formed in the duct member.

Additionally, in the above-described inventions, the drying apparatus of the present invention comprises: a refrigerant circuit in which a compressor, a radiator, a decompression device, an evaporator and the like are successively connected to one another in an annular form via a piping; and blower means for discharging drying air which has exchanged heat with the radiator into an accommodating chamber to exchange the heat of the air passed through the accommodating chamber with the evaporator.

Moreover, in the drying apparatus of the present invention, the refrigerant circuit uses carbon dioxide as a refrigerant, and has a supercritical pressure on a high pressure side thereof.

In this case, according to the present invention, in the drying apparatus in which the drying air is supplied into the accommodating chamber constituted in the rotating drum to perform the drying operation of the laundry to be dried accommodated in the accommodating chamber, since the discharge ports for discharging the drying air are formed on the opposite sides of the rotating drum in the rotation axis direction, the laundry to be dried is brought into good contact with the drying air as compared with a case where the drying air is discharged into the accommodating chamber from one direction, and uniform drying and reduction of a drying time can be realized. Especially since the drying air is discharged into the accommodating chamber from the opposite sides of the rotating drum in the rotation axis direction, the discharge ports are not easily closed by the laundry to be dried, and the drying air is smoothly passed.

Moreover, according to the present invention, since the drying apparatus further comprises: the discharge port formed in the rotating drum on one side of the rotation axis; the discharge port formed on the other side; and the duct member for guiding the drying air from one side of the rotation axis of the rotating drum to the discharge port on the other side. Therefore, the drying air can be guided into the discharge port on the other side with a simple structure. Moreover, since the temperature of the rotating drum itself also rises via the duct member, a drying performance is further improved. Since the duct member protrudes from the inner wall of the rotating drum, the laundry to be dried in the accommodating chamber is tumbled by the duct member. Accordingly, the reduction of the drying time of the laundry to be dried and the uniform drying can further be promoted.

Moreover, according to the present invention, since the discharge port is formed in the duct member, the drying air can also be discharged into the accommodating chamber from the duct member. Accordingly, the drying air is further sprayed to the laundry to be dried in the accommodating chamber from multiple directions, and the uniform drying and the shortening of the drying time can be achieved.

Furthermore, according to the present invention, the drying apparatus further comprises: the refrigerant circuit in which the compressor, radiator, decompression device, evaporator and the like are successively connected to one another in the annular form via the piping; and the blower means for discharging the drying air which has exchanged the heat with the radiator into the accommodating chamber to exchange the heat of the air passed through the accommodating chamber with the evaporator. Therefore, the laundry to be dried accommodated in the accommodating chamber is heated by the drying air heated at the high temperature by the radiator, and moisture evaporated from the dried laundry can be coagulated by the evaporator and discarded.

Accordingly, a time required for the drying is effectively shortened, and an energy efficiency can be largely raised. Since the air containing a lot of moisture does not have to be discarded to the outside of the accommodating chamber by dehumidifying, an environment of a room in which the drying apparatus is installed is not deteriorated, and it is possible to eliminate an equipment cost for improving the room environment.

Moreover, according to the present invention, additionally, the refrigerant circuit uses carbon dioxide as the refrigerant and has the supercritical pressure on the high pressure side. Therefore, the temperature of the radiator can be set at a high temperature. Accordingly, the drying air to be circulated in the accommodating chamber is maintained at the high temperature, the laundry to be dried accommodated in the accommodating chamber is dried in a shorter time, and energy consumption for use in the drying can further be reduced.

DETAILED DESCRIPTION OF THE PREFERRED EMBODIMENT

Figure 1:
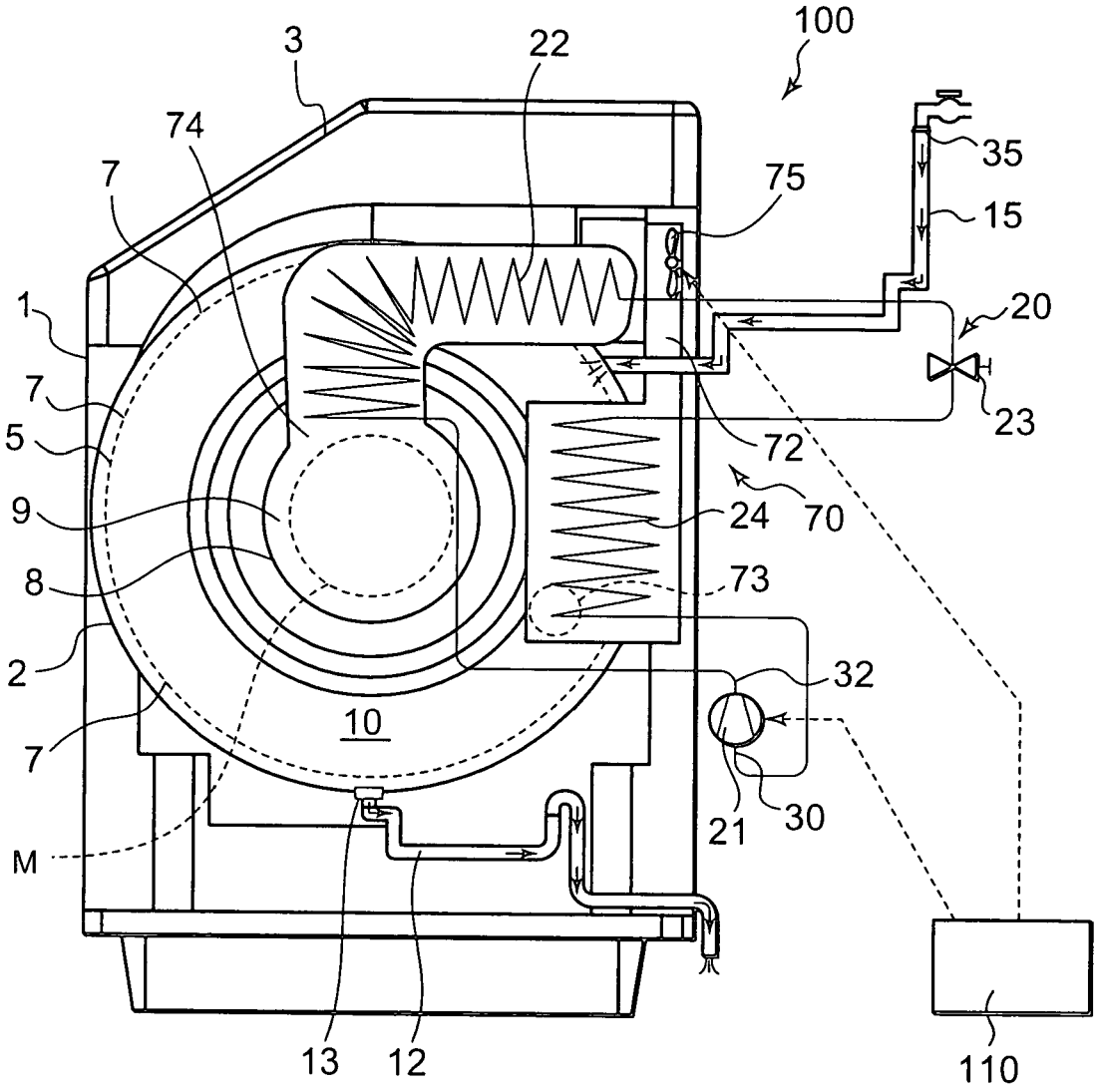
FIG. 1 is an inner constitution diagram of a washing/drying apparatus which is an embodiment of a drying apparatus of the present invention.

FIG. 1 shows an inner constitution diagram viewed from the side surface of a washing/drying apparatus 100 which is one embodiment of a drying apparatus of the present invention. The washing/drying apparatus 100 of the embodiment is used in washing and drying laundry such as clothing. An opening/closing door 3 for inserting/removing the laundry is attached to a middle portion of the upper surface of a main body 1 forming an outer structure, and an operation panel (not shown) in which various operation switches and a display portion are disposed is disposed on the upper surface of the main body 1 beside the opening/closing door 3.

A cylindrical resin outer drum 2 capable of storing water is disposed in the main body 1, and the outer drum 2 is disposed with respect to an axis of a cylinder which is a right/left direction. Moreover, a cylindrical stainless steel inner drum 5 which serves both as a washing tank and a spin-drying tank is disposed inside the outer drum 2. The inside of the inner drum 5 is constituted as an accommodating chamber 10, and is also disposed with respect to the axis of the cylinder which is the right/left direction. The axis is connected to a shaft 8 of a driving motor M attached to a side wall (inner side of FIG. 1) of the main body 1, and the inner drum 5 is held rotatably in the outer drum 2 centering on the shaft 8.

A watertight opening/closing lid (not shown) for inserting/removing the laundry is disposed corresponding to the opening/closing door 3 in an upper part of the outer drum 2. A large number of through-holes 7 . . . via which air and water can circulate are formed in a whole peripheral wall of the inner drum 5. A stopping position of the inner drum 5 is defined, and an opening/closing lid (not shown) for inserting/removing the laundry is disposed in a position (upper surface) of the inner drum corresponding to the opening/closing lid of the outer drum 2 at the time of stopping.

The driving motor M is a motor for rotating the inner drum 5 centering on the shaft 8 in the right/left direction in a washing operation and a drying operation after end of the washing operation. The driving motor M is attached to one end of the shaft 8, and is controlled by a control device 110 which is control means described later in such a manner as to rotate the inner drum 5 at a low speed at the time of the drying operation as compared with the washing operation.

A hollow portion 9 whose inner portion is formed to be hollow is formed in the other end of the shaft 8, and an air circulation path 72 described later is connected to the inside of the inner drum 5 via the hollow portion 9.

On the other hand, a water supply passage 15 which is water supply means for supplying water into the inner drum 5 is disposed in the upper part of the main body 1, and one end of the water supply passage 15 is connected to a water source of tap water or the like via a water supply valve 35 also constituting the water supply means. The water supply valve 35 is controlled to open/close by the control device 110. The other end of the water supply passage 15 is connected to the outer drum 2 to communicate with the inside of the drum, and is constituted in such a manner that water (tap water) is supplied to the accommodating chamber 10 in the inner drum 5 disposed in the outer drum 2 from the water source, when the water supply valve 35 is opened by the control device 110.

A draining passage 12 which is draining means for discharging the water of the accommodating chamber 10 in the inner drum 5 is disposed in a lower part of the main body 1, and one end of the draining passage 12 communicates with a bottommost portion of the outer drum 2 via a draining valve 13 (also constituting the draining means) which is controlled to open/close by the control device 110. The other end of the draining passage 12 is derived to the outside of the washing/drying apparatus 100, and extends to a drain ditch or the like.

On the other hand, a machine chamber 70 is constituted under the outer drum 2 in the main body 1 and/or on a rear to lateral side of the drum in the washing/drying apparatus 100, and the air circulation path 72 is constituted in the machine chamber 70.

An inlet 73 is formed in one end of the air circulation path 72, and an evaporator 24 of a refrigerant circuit 20 described later is disposed in the air circulation path 72 in the vicinity of the inlet 73 of the air circulation path 72. Moreover, the inlet 73 of the air circulation path 72 communicates with a rear part in the outer drum 2. An outlet 74 is formed in the other end of the air circulation path 72, and a gas cooler 22 of the refrigerant circuit 20 described later is disposed in the air circulation path 72 in the vicinity of the outlet 74. The outlet 74 of the air circulation path 72 opens in the hollow portion 9 formed in the other end of the shaft 8.

Moreover, a blower 75 which is blower means is disposed in the air circulation path 72, and air is supplied into the accommodating chamber 10 in the inner drum 5 from the outlet 74 of the air circulation path 72 via the hollow portion 9 of the shaft 8. That is, in the washing/drying apparatus 100, the air in the inner drum 5 is circulated in the air circulation path 72 by the blower 75 at the time of the drying operation to heat the air by heat exchange with the gas cooler 22 disposed on the side of the outlet 74 of the air circulation path 72. Thereafter, the air is discharged into the accommodating chamber 10 in the inner drum 5. Moreover, the air circulated in the accommodating chamber 10 to dry the laundry is drawn in the air circulation path 72 from the inlet 73, and cooled by heat exchange with the evaporator 24 disposed on the side of the inlet 73. After the air is dehumidified, the air is drawn in the blower 75 again, blown into the gas cooler 22, and discharged into the accommodating chamber 10.

Next, in FIG. 1, reference numeral 20 denotes the refrigerant circuit, and the refrigerant circuit 20 is constituted by successively connecting a compressor 21, the gas cooler 22, an expansion valve 23 which is a decompression device, the evaporator 24 and the like to one another in an annular form via a piping. A predetermined amount of carbon dioxide ($CO_2$) is sealed as a refrigerant in the refrigerant circuit 20. Here, the compressor 21 for use in the present embodiment is a rotary compressor of an inner intermediate pressure type multistage compression system, and an electromotive element, and a first rotary compression element (first stage) and a second rotary compression element (second stage) driven by the electromotive element are disposed in an airtight container (not shown).

A low-pressure refrigerant is introduced into the first rotary compression element of the compressor 21 from a refrigerant guide pipe 30, and a high-temperature/pressure refrigerant compressed by the second rotary compression element is discharged to the outside of the compressor 21 from a refrigerant discharge pipe 32.

The refrigerant discharge pipe 32 of the compressor 21 is connected to the inlet of the gas cooler 22 for heating the air, disposed on the side of the outlet 74 of the air circulation path 72. The piping extending from the gas cooler 22 reaches the expansion valve 23. An outlet of the expansion valve 23 reaches the inlet of the evaporator 24, and the outlet of the evaporator 24 is connected to the refrigerant guide pipe 30 to reach the compressor 21.

It is to be noted that the above-described control device 110 is control means for controlling the washing/drying apparatus 100, and controls operating of the driving motor M, opening/closing of the water supply valve 35 of the water supply passage 15, opening/closing of the draining valve 13 of the draining passage 12, operating of the compressor 21, throttle adjusting of the expansion valve 23, and an air amount of the blower 75. Furthermore, the control device 110 also controls the temperature of the air passed through the gas cooler 22 in order to prevent the laundry accommodated in the inner drum 5 from being discolored or damaged.

Next, an operation of the washing/drying apparatus 100 constituted as described above will be described. Laundry and a predetermined amount of washing powder corresponding to an amount of the laundry are thrown into the accommodating chamber 10 in the inner drum 5. When a power switch and a start switch are operated among the above-described operation switches, the control device 110 starts a washing operation. Moreover, the control device 110 opens the water supply valve 35 of the water supply passage 15 to open the water supply passage 15. Accordingly, water is supplied into the accommodating chamber 10 of the inner drum 5 in the outer drum 2 from the water source. It is to be noted that the draining valve 13 of the draining passage 12 is closed by the control device 110.

When a predetermined amount of water is stored in the accommodating chamber 10 in the inner drum 5, the control device 110 closes the water supply valve 35 to close the water supply passage 15. Accordingly, water supply from the water source is stopped.

Next, the driving motor M formed in the side surface of the main body 1 is energized/started by the control device 110 to rotate the shaft 8, accordingly the inner drum 5 attached to the shaft 8 starts rotating in the outer drum 2, and a washing process of the washing operation is started.

When a predetermined time elapses from the start of the washing process, the driving motor M is stopped by the control device 110, and the draining valve 13 of the draining passage 12 is opened to discharge the water (washing water) in the accommodating chamber 10 (i.e., the outer drum 2) of the inner drum 5.

Moreover, when the water in the accommodating chamber 10 of the inner drum 5 is discharged, the control device 110 operates the driving motor M again to spin-dry the laundry. After performing the spin-drying for a predetermined time, the control device 110 closes the draining valve 13 of the draining passage 12.

Next, the control device 110 shifts to a rinsing process, and opens the water supply valve 35 of the water supply passage 15 to open the water supply passage 15. Accordingly, the water is supplied to the accommodating chamber 10 in the inner drum 5 from the water source again.

When a predetermined amount of water is supplied to the accommodating chamber 10 in the inner drum 5, the control device 110 closes the water supply valve 35 to close the water supply passage 15. Accordingly, the water supply from the water source is stopped.

Moreover, after a rotation operation of the driving motor M is repeated for a predetermined time to perform the rinsing, the control device 110 stops the driving motor M, and opens the draining valve 13 of the draining passage 12 to discharge the rinsing water in the accommodating chamber 10 to the draining passage 12.

Here, the electromotive element of the compressor 21 is started simultaneously with the opening of the draining valve 13. Accordingly, the refrigerant ($CO_2$) is drawn in the first rotary compression element of the compressor 21, and compressed. The refrigerant compressed by the first rotary compression element and having an intermediate pressure is discharged into the airtight container, the refrigerant discharged into the airtight container is drawn in the second rotary compression element, the compression of the second stage is performed to obtain a refrigerant gas at a high temperature and pressure, and the gas is discharged to the outside from the refrigerant discharge pipe 32.

The refrigerant gas discharged from the refrigerant discharge pipe 32 flows into the gas cooler 22. In the gas cooler 22, the high-temperature/pressure refrigerant compressed by the compressor 21 is not condensed, and the cooler is operated in a supercritical state. The temperature of the refrigerant which flows into the gas cooler 22 rises at about +130° C., and the high-temperature/pressure refrigerant gas radiates heat in the gas cooler 22. The refrigerant which has flown from the gas cooler 22 is decompressed by the expansion valve 23, next flows into the evaporator 24, absorbs heat from its periphery, evaporates, and is drawn in the first rotary compression element of the compressor 21 from the refrigerant guide pipe 30. This circulation is performed. It is to be noted that at this time the blower 75 is not operated. That is, the air in the air circulation path 72 heated by the gas cooler 22 is not discharged into the accommodating chamber 10.

On the other hand, when the rinsing water in the accommodating chamber 10 is discharged, the control device 110 operates the driving motor M again, rotates the inner drum 5 in the same manner as described above, and shifts to a spin-drying process to spin-dry the laundry. Moreover, after performing the spin-drying process for a predetermined time, the control device 110 closes the draining valve 13 and shifts to a drying operation.

When shifting to the drying operation, the control device 110 starts the operation of the blower 75. Accordingly, the high-temperature air heated by the heat radiation of the high-temperature/pressure refrigerant in the gas cooler 22 flows out into the hollow portion 9 from the outlet 74 of the air circulation path 72, and is discharged into the accommodating chamber 10 of the inner drum 5.

In this case, since the operation of the compressor 21 is started before the drying operation as described above, the gas cooler 22 is at a sufficiently high temperature at the time when the operation shifts to the drying operation to start the operation of the blower 75. Accordingly, the high-temperature air heated by the gas cooler 22 can be discharged into the accommodating chamber 10 at the start of the drying operation.

Here, when the machine enters the drying operation and thereafter the operation of the compressor 21 starts, the temperature of the refrigerant flowing into the gas cooler 22 does not instantly rise. Therefore, in an initial stage of the drying operation, the temperature of the gas cooler 22 does not sufficiently rise, and also the temperature of the circulating air does not rise. Moreover, since the temperature of the evaporator 24 does not lower, the moisture-containing air flowing out of the accommodating chamber 10 cannot be sufficiently cooled or dehumidified in the evaporator 24. Therefore, a drying time of the laundry also lengthens.

On the other hand, when the operation of the compressor 21 is started before entering the drying operation as in the present invention, the temperature of the refrigerant entering the gas cooler 22 is raised, and the gas cooler 22 is heated beforehand at a high temperature before starting the drying operation. Therefore, the high-temperature air can be blown in the accommodating chamber 10 simultaneously with the start of the drying operation. Accordingly, a water content of the laundry can be effectively evaporated from the start of the drying operation.

Furthermore, since the operation of the compressor 21 is started before entering the drying operation, the evaporator 24 can be cooled at a low temperature until the start of the drying operation. Therefore, the air flowing out of the accommodating chamber 10 and containing the moisture can be cooled and sufficiently dehumidified. Accordingly, a heating capability by the gas cooler 22 and a dehumidifying capability by the evaporator 24 at the start of the drying operation are improved, and the drying time of the laundry can be remarkably shortened.

It is to be noted that in the present embodiment the control device 110 starts the operation of the blower 75 when entering the drying operation, but the present invention is not limited to the embodiment. The control device 110 may start the operation of the blower 75 before entering the drying operation, for example, when entering the spin-drying process or from the middle of the spin-drying process. In this case, since the high-temperature air heated by the gas cooler 22 is discharged into the accommodating chamber 10 even during the spin-drying process, the laundry and the stainless steel inner drum 5 during the spin-drying can also be heated, and the drying time can further be shortened.

Figure 2:
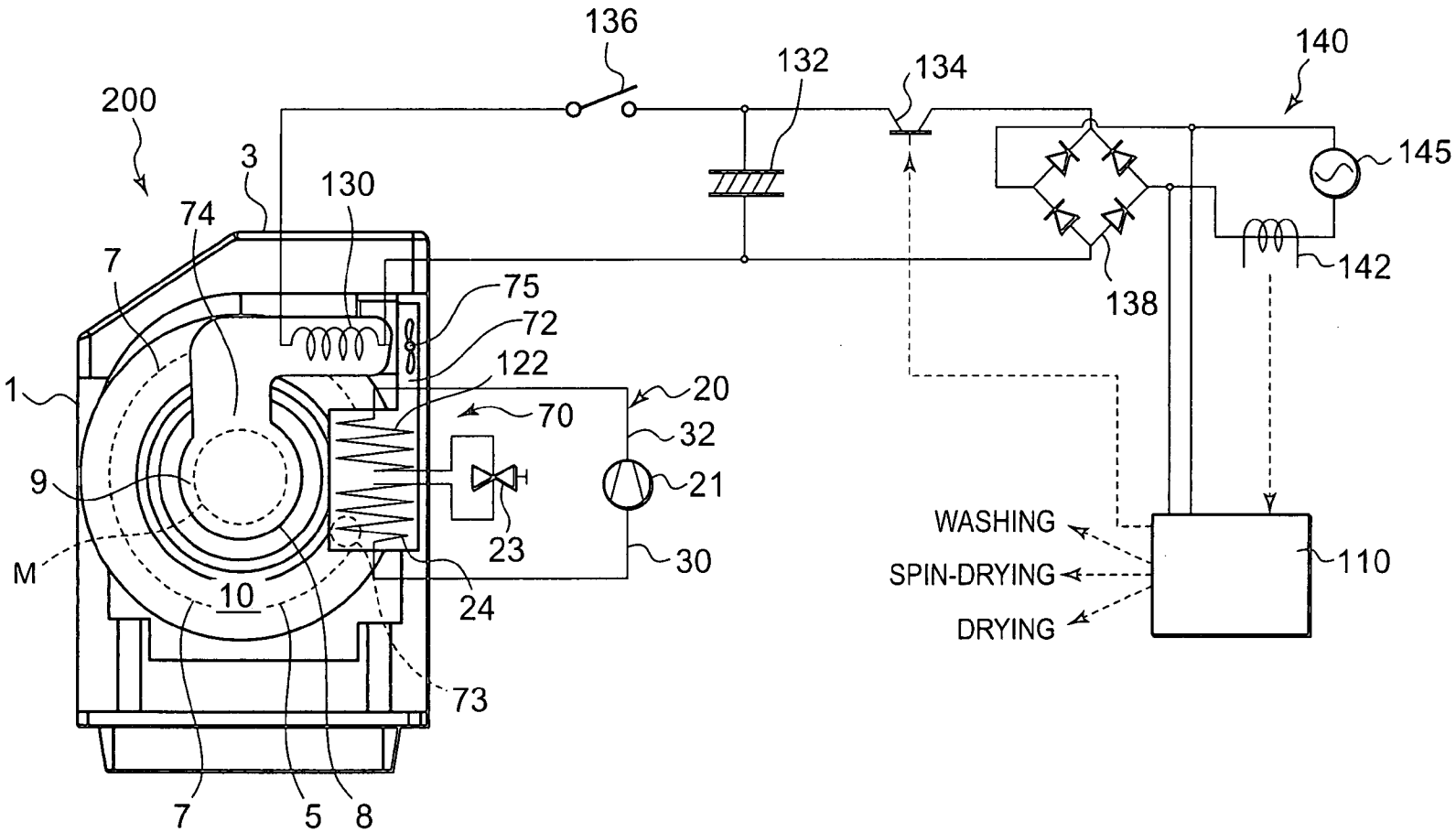
FIG. 2 is an inner constitution diagram of a washing/drying apparatus which is another embodiment of the drying apparatus of the present invention.

Next, a washing/drying apparatus which is another embodiment of the drying apparatus of the present invention will be described in detail with reference to FIG. 2. FIG. 2 shows an inner constitution diagram of a washing/drying apparatus 200 viewed from its side surface in this case. It is to be noted that in FIG. 2, parts denoted with the same reference numerals as those of FIG. 1 produce the same or similar effect.

In FIG. 2, a gas cooler 122 of a refrigerant circuit 20 is disposed before a blower 75 in an air circulation path 72. In the air circulation path 72 an electric heater 130 is disposed in the vicinity of an outlet 74 formed in the other end of the air circulation path 72. The electric heater 130 heats air discharged into the accommodating chamber 10 at the time of a drying operation.

That is, in the washing/drying apparatus 200 of the embodiment, the air in an inner drum 5 is circulated in the air circulation path 72 by the blower 75 at the time of the drying operation, and accordingly the air exchanges heat with the gas cooler 122 disposed before the blower 75 of the air circulation path 72 to heat the air. Thereafter, the air is heated by the electric heater 130 disposed on the side of the outlet 74 of the air circulation path 72, and discharged into the accommodating chamber 10 in the inner drum 5. Moreover, the air which has circulated in an accommodating chamber 10 to dry laundry is drawn in the air circulation path 72 from an inlet 73, exchanges heat with an evaporator 24 disposed on the side of the inlet 73, and is cooled and dehumidified. The air is heated by the gas cooler 122 again, drawn in the blower 75, blown in the electric heater 130, and discharged into the accommodating chamber 10.

As described above, when the air heated by the heat exchange in the gas cooler 122 is further heated by the electric heater 130 at the time of the drying operation, the air discharged into the accommodating chamber 10 can be heated at a high temperature.

Especially, the temperature of the gas cooler 122 does not rise immediately after the operation of a compressor 21 starts at the start of the drying operation as described above, and the air in the air circulation path 72 cannot be sufficiently heated. Therefore, when the laundry in the accommodating chamber 10 is heated, a water content cannot be sufficiently evaporated. However, since the washing/drying apparatus 200 of the present embodiment can further heat the air passed through the gas cooler 122 by the electric heater 130, the high-temperature air can be constantly blown in the accommodating chamber 10. Accordingly, a heating capability at the start of the drying operation is improved, and a drying time of the laundry can be remarkably shortened.

Here, the electric heater 130 is connected to an electric circuit 140 including a battery 132 which is power accumulation means for accumulating power to be supplied to the electric heater 130. That is, the electric circuit 140 is constituted of the electric heater 130, the battery 132, a control switch 134 for controlling power supply to the battery 132, a switch 136 for turning on/off the power supply to the electric heater 130 (power supply from the battery 132) and the like. Moreover, the battery 132 is connected to a power source 145 (commercial alternating current of 100 V) via a rectifier 138. It is to be noted that the control switch 134 is connected to a control device 110. When the control switch 134 is turned on by the control device 110, power is accumulated in the battery 132. When the control switch 134 is turned off, the power accumulation into the battery 132 is stopped.

Moreover, reference numeral 142 denotes a detector (CT) which detects a current value flowing through the washing/drying apparatus 200, and an output of the detector 142 is connected to the control device 110. Moreover, the control device 110 controls the power accumulation into the battery 132 of the electric circuit 140 in such a manner that the current value detected by the detector 142 is within a range of a power input limitation (15 A) of the washing/drying apparatus 200. That is, when the current value detected by the detector 142 reaches 15A, the control device 110 turns off the control switch 134.

Figure 4:
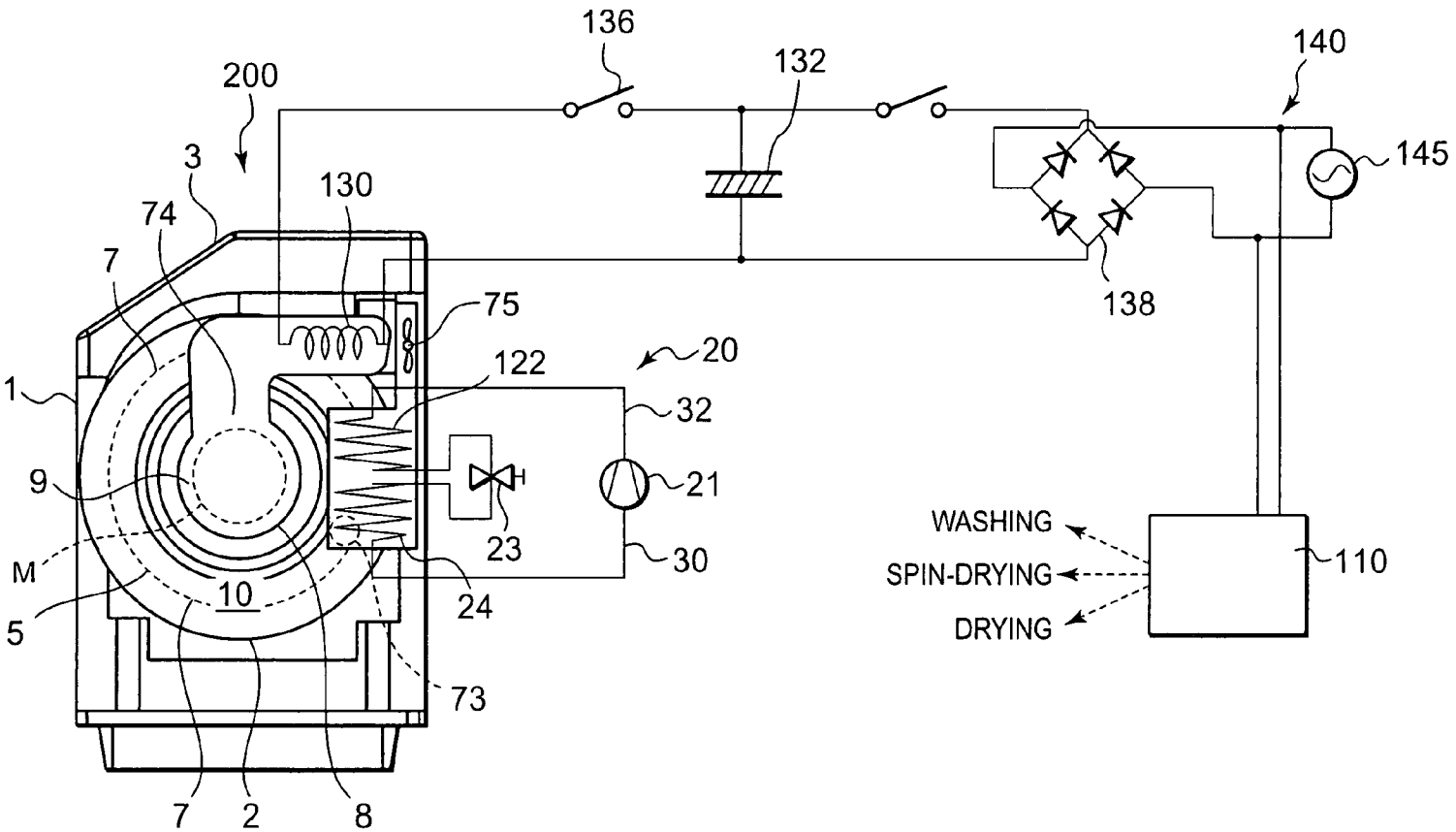
FIG. 4 is a diagram showing an electric circuit in a case where power control within a range of an electricity input upper limit is not executed.

When the power accumulation into the battery 132 is not controlled by the control device 110 as described above (an electric circuit in this case is shown in FIG. 4), the power is supplied to the battery 132 even at the current value of 15 A. That is, since the value exceeds the power input limitation of the washing/drying apparatus 200, an electric work has to be performed anew. Even when the electric heater 130 is directly operated at the time of the drying operation without accumulating any power by the battery 132, a large amount of power is similarly required for the drying operation. Therefore, when the electric heater 130 operates, the value exceeds the power input limitation.

However, since the battery 132 for accumulating the power to be supplied to the electric heater 130 is disposed, and power is accumulated into the battery 132 within the range of the power input limitation by the control device 110, the above-described disadvantage can be avoided. Accordingly, an increase of a power equipment cost of the washing/drying apparatus 200 can be suppressed to the utmost.

Next, an operation of the washing/drying apparatus 200 in this case will be described. It is to be noted that an operation other than that of the compressor 21 in a washing operation is similar to that of the first embodiment, but during the washing operation, the control device 110 turns on/off the control switch 134 to supply the power to the battery 132, and the power is accumulated in the battery 132. It is to be noted that the compressor 21 is still stopped. When a total current value for use in the operation of the washing/drying apparatus 200, detected by the detector 142, reaches the power input limitation (15 A), the control device 110 turns off the control switch 134 to stop the power supply into the battery 132 as described above. When the predetermined amount of power is accumulated in the battery 132, or the power is accumulated for a predetermined time, the control device 110 turns off the control switch 134.

On the other hand, upon entering the drying operation, the control device 110 starts the electromotive element of the compressor 21, and also starts the operation of the blower 75. Accordingly, a refrigerant ($CO_2$) is drawn in the first rotary compression element of the compressor 21, and compressed. The refrigerant compressed by the first rotary compression element and having an intermediate pressure is discharged into the airtight container, the refrigerant discharged into the airtight container is drawn in the second rotary compression element, the compression of the second stage is performed to obtain a refrigerant gas at a high temperature and pressure, and the gas is discharged to the outside from the refrigerant discharge pipe 32.

The refrigerant gas discharged from the refrigerant discharge pipe 32 flows into the gas cooler 122. Here, the high-temperature/pressure refrigerant compressed by the compressor 21 is not condensed, and the cooler is operated in a supercritical state. The temperature of the refrigerant which flows into the gas cooler 122 rises at about +130° C., and the high-temperature/pressure refrigerant gas radiates heat in the gas cooler 122. The refrigerant which has flown from the gas cooler 122 is decompressed by the expansion valve 23, next flows into the evaporator 24, absorbs heat from its periphery, evaporates, and is drawn in the first rotary compression element of the compressor 21 from the refrigerant guide pipe 30. This circulation is performed.

Moreover, the control device 110 turns on the switch 136 of the electric circuit 140 simultaneously with the starting of the compressor 21. Accordingly, the power accumulated in the battery 132 is supplied to the electric heater 130, and the electric heater 130 generates heat.

Moreover, by the operation of the blower 75, the air heated by heat radiation of the high-temperature/pressure refrigerant in the gas cooler 122 is drawn in the blower 75, thereafter passes through the electric heater 130, and is further heated at a high temperature by the electric heater 130. The air flows out into the hollow portion 9 from the outlet 74 of the air circulation path 72, and is discharged into the accommodating chamber 10 of the inner drum 5.

Here, as described above, the temperature of the gas cooler 122 does not instantly rise at the start of the operation of the compressor 21. However, when the air blown in the accommodating chamber 10 is heated by the gas cooler 122 and the electric heater 130, the air heated at the high temperature can be blown into the accommodating chamber 10 even at the start of the drying operation. Accordingly, a heating capability at the start of the drying operation is improved, and a drying time of the laundry can be remarkably shortened.

Especially when the power is accumulated in the battery 132 during the washing operation, the power can be accumulated immediately before the start of the drying operation, natural electric discharge is suppressed to the utmost, and energy can be efficiently used.

It is to be noted that in the present embodiment, the power is accumulated into the battery 132 during the washing operation, but the present invention is not limited to this embodiment, and the power may be accumulated into the battery 132 before the washing operation of the washing/drying apparatus 200. In this case, for example, when the power is accumulated into the battery 132 using midnight power, operation costs can be reduced. The electric heater 130 may be energized at the start of the drying operation, for example, only for a present time after the start of the drying operation.

Figure 3:
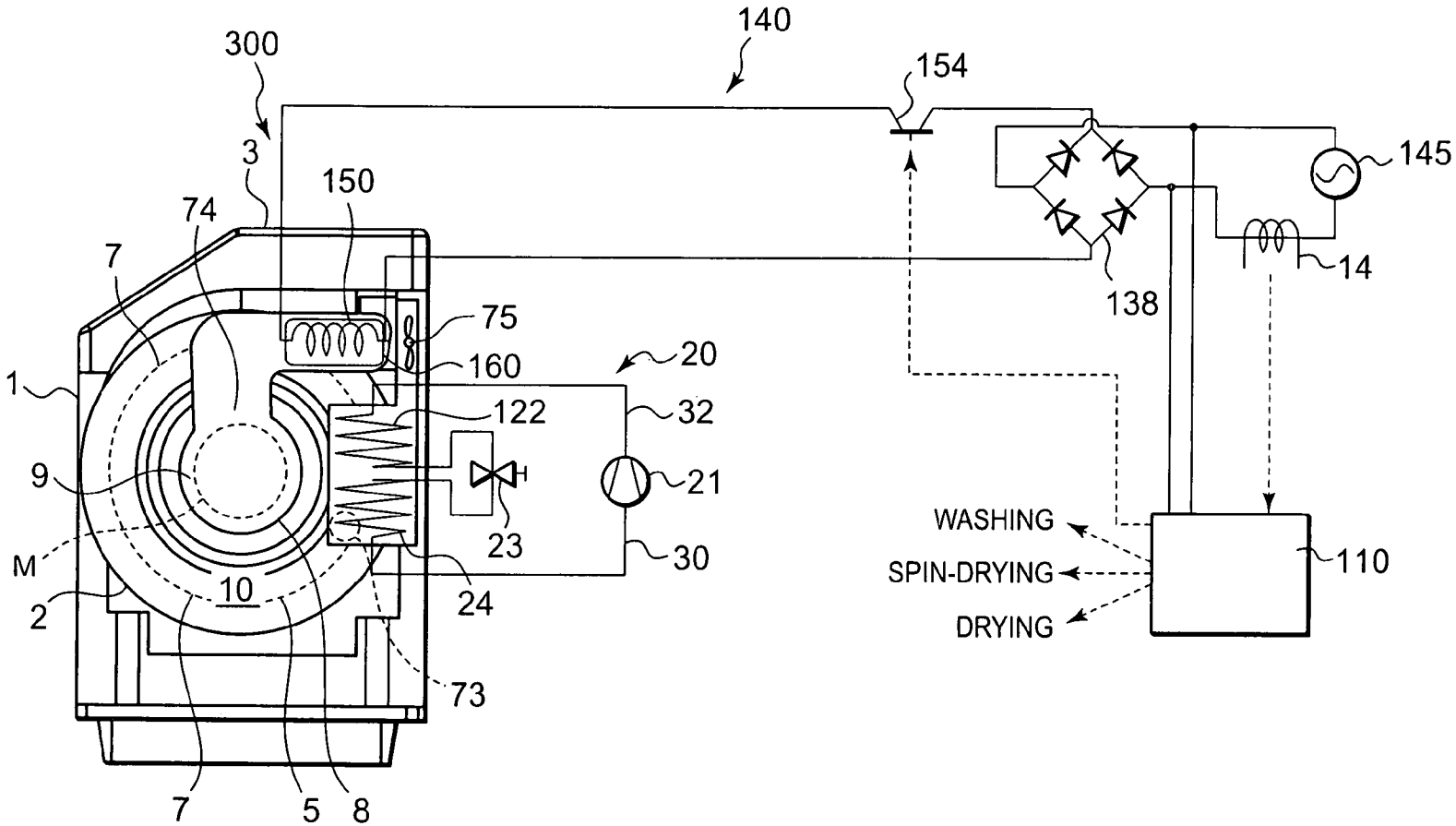
FIG. 3 is an inner constitution diagram of a washing/drying apparatus which is still another embodiment of the drying apparatus of the present invention.

Next, a washing/drying apparatus which is still another embodiment of the drying apparatus of the present invention will be described in detail with reference to FIG. 3. FIG. 3 shows an inner constitution diagram of a washing/drying apparatus 300 viewed from its side surface in this case. It is to be noted that in FIG. 3, parts denoted with the same reference numerals as those of FIGS. 1 and 2 produce the same or similar effect.

In FIG. 3, reference numeral 150 denotes an electric heater in this case, and a heat storage material 160 which stores heat by heating of the electric heater 150 is disposed in a heat exchange manner in the electric heater 150. Moreover, in an air circulation path 72, the heat storage material 160 is disposed in the vicinity of an outlet 74 formed in the other end of the air circulation path 72. In an electric circuit 140, a control switch 154 for controlling power supply into the electric heater 150 is disposed, and is controlled to turn on/off by a control device 110. Moreover, when a current value detected by a detector 142 reaches 15 A, the control device 110 turns off the control switch 154 to stop power supply into the electric heater 150. The control device 110 heats the air discharged into an accommodating chamber 10 by heat radiation of the heat storage material 160 at the time of a drying operation.

That is, in the washing/drying apparatus 300 of the present embodiment, the air in an inner drum 5 is circulated in the air circulation path 72 by a blower 75 at the time of the drying operation, and the air is heated by the heat exchange with a gas cooler 122 disposed before the blower 75 of the air circulation path 72. Therefore, the air is further heated by the heat storage material 160 disposed on the side of the outlet 74 of the air circulation path 72, and discharged into the accommodating chamber 10 in the inner drum 5. Moreover, the air circulated in the accommodating chamber 10 to dry the laundry is drawn in the air circulation path 72 from an inlet 73, exchanges the heat with an evaporator 24 disposed on the side of the inlet 73, and is cooled and dehumidified. Thereafter, the air is heated by the gas cooler 122 again, drawn in the blower 75, blown in the heat storage material 160, and discharged into the accommodating chamber 10.

As described above, when the air heated by the heat exchange in the gas cooler 122 at the time of the drying operation is further heated by the heat storage material 160, the air discharged into the accommodating chamber 10 can be heated at a high temperature.

Especially at the start of the drying operation and immediately after the start of the operation of a compressor 21, the gas cooler 122 is not warmed as described above, and the air in the air circulation path 72 cannot be sufficiently heated. Therefore, when laundry in the accommodating chamber 10 is heated, moisture cannot be removed.

However, in the washing/drying apparatus 300 of the present embodiment, since the air passed through the gas cooler 122 can be heated by the heat storage material 160 heated beforehand by the electric heater 150, the high-temperature air can be constantly blown in the accommodating chamber 10. Even in this case, a drying time of the laundry can be remarkably shortened in the same manner as in the above-described embodiments.

Here, the control device 110 controls energization into the electric heater 150 in such a manner that the current value detected by the detector 142 is within a range of a power input limitation (15 A) of the washing/drying apparatus 300. That is, when the current value detected by the detector 142 reaches 15 A, the control device 110 turns off the control switch 154.

When the energization into the electric heater 150 is not controlled by the control device 110 as described above, the power is supplied into the electric heater 150 even at a current value of 15 A. That is, since the value exceeds the power input limitation of the washing/drying apparatus 300, an electric work has to be performed anew. Even when the electric heater 130 is directly operated at the time of the drying operation without storing any heat into the heat storage material 160, a large amount of power is similarly required for the drying operation. Therefore, when the electric heater 150 operates, the value exceeds the power input limitation.

However, since the heat storage material 160 heated by the electric heater 150 is disposed, the electric heater 150 is energized within the range of the power input limitation by the control device 110, and the generated heat is stored in the heat storage material 160, the above-described disadvantage can be avoided. Accordingly, an increase of a power equipment cost of the washing/drying apparatus 300 can be suppressed to the utmost.

Next, an operation of the washing/drying apparatus 300 in this case will be described. It is to be noted that an operation other than that of the compressor 21 in a washing operation is similar to that of the first embodiment, but during the washing operation, the control device 110 turns on/off the control switch 154 to energize the electric heater 150, and the heat storage material 160 is heated to store the heat. It is to be noted that the compressor 21 is still stopped. When a total current value for use in the operation of the washing/drying apparatus 300, detected by the detector 142, reaches the power input limitation (15 A), the control device 110 turns off the control switch 154 to stop the energization into the electric heater 150 as described above. When the heat storage into the heat storage material 160 completes, or the heat is stored for a predetermined time, the control device 110 turns off the control switch 154.

On the other hand, upon entering the drying operation, the control device 110 starts the electromotive element of the compressor 21, and also starts the operation of the blower 75. Accordingly, a refrigerant ($CO_2$) is drawn in the first rotary compression element of the compressor 21, and compressed. The refrigerant compressed by the first rotary compression element and having an intermediate pressure is discharged into the airtight container, the refrigerant discharged into the airtight container is drawn in the second rotary compression element, the compression of the second stage is performed to obtain a refrigerant gas at a high temperature and pressure, and the gas is discharged to the outside from the refrigerant discharge pipe 32.

The refrigerant gas discharged from the refrigerant discharge pipe 32 flows into the gas cooler 122. Here, the high-temperature/pressure refrigerant compressed by the compressor 21 is not condensed, and the cooler is operated in a supercritical state. The temperature of the refrigerant which flows into the gas cooler 122 rises at about +130° C., and the high-temperature/pressure refrigerant gas radiates heat in the gas cooler 122. The refrigerant which has flown from the gas cooler 122 is decompressed by the expansion valve 23, next flows into the evaporator 24, absorbs heat from its periphery, evaporates, and is drawn in the first rotary compression element of the compressor 21 from the refrigerant guide pipe 30. This circulation is performed.

Moreover, by the operation of the blower 75, the air heated by the heat radiation of the high-temperature/pressure refrigerant in the gas cooler 122 is drawn in the blower 75, passed through the heat storage material 160, and further heated by the heat storage material 160 at the high temperature. The air flows out into the hollow portion 9 from the outlet 74 of the air circulation path 72, and is discharged into the accommodating chamber 10 of the inner drum 5.

Here, the temperature of the gas cooler 122 does not instantly rise at the start of the operation of the compressor 21 as described above. However, when the air blown in the accommodating chamber 10 is heated by the gas cooler 122 and the heat storage material 160, the air heated at the high temperature can be blown in the accommodating chamber 10 even at the start of the drying operation. Accordingly, a heating capability at the start of the drying operation is improved, and a drying time of laundry can be remarkably shortened.

Especially when the heat is stored in the heat storage material 160 during the washing operation, the heat can be stored in the heat storage material 160 immediately before the start of the drying operation, the heat radiation is suppressed to the utmost, and energy can be efficiently used.

It is to be noted that in the above-described embodiment, the heat is stored into the heat storage material 160 during the washing operation, but the present invention is not limited to this embodiment, and the heat may be stored into the heat storage material 160 before the washing operation of the washing/drying apparatus 300. In this case, for example, when the energization into the electric heater 150 is performed using midnight power, operation costs can be reduced.

It is to be noted that the compressor 21 for use in the above-described embodiments is formed into the rotary compressor of the inner intermediate pressure type multi-stage (two stages) compression system including the first and second rotary compression elements, but the compressor 21 usable in the present invention is not limited to this compressor.

Figure 5:
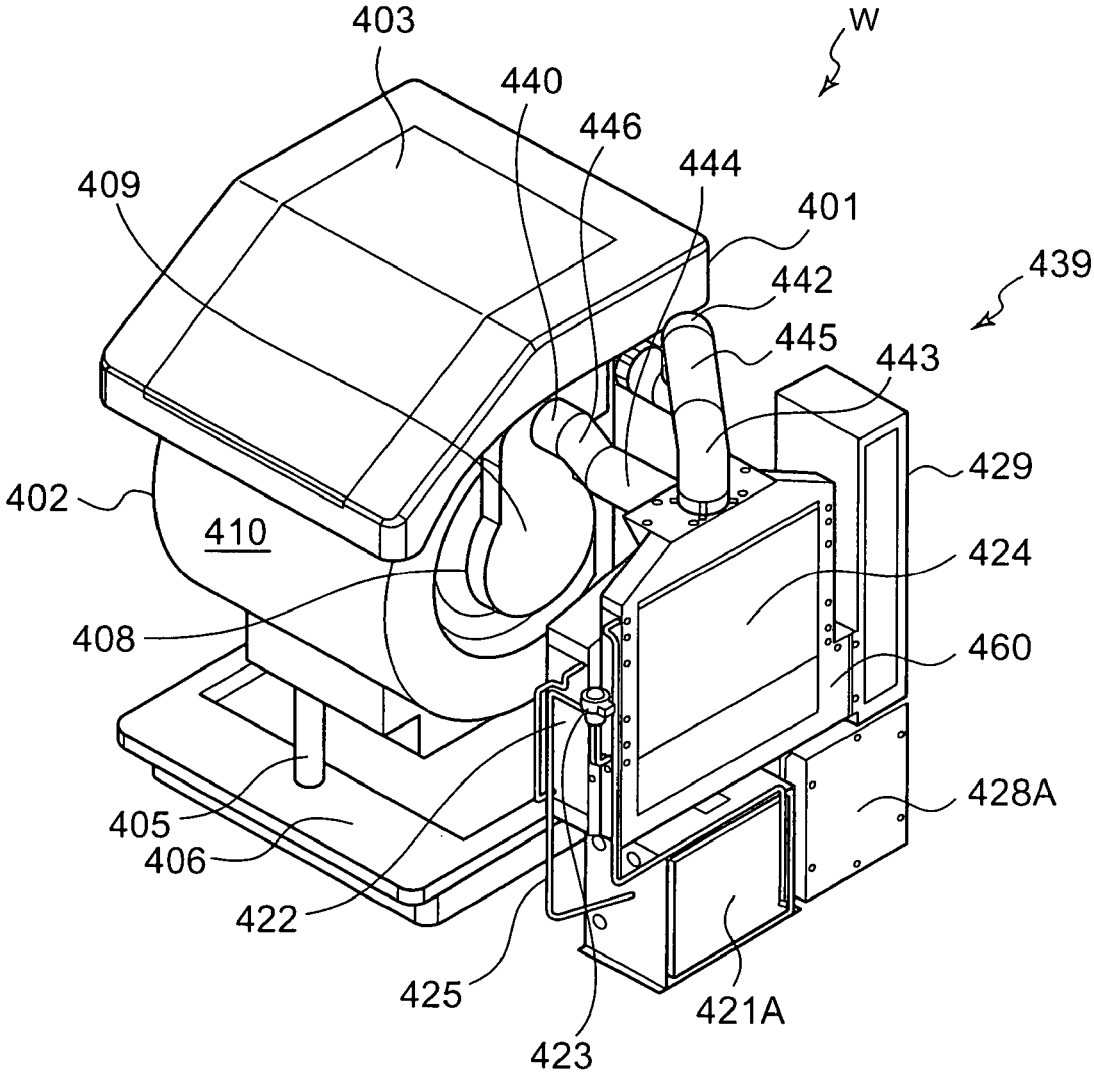
FIG. 5 is an inner constitution diagram of the washing/drying apparatus which is another embodiment of the drying apparatus of the present invention as seen obliquely from a front side.
Figure 6:
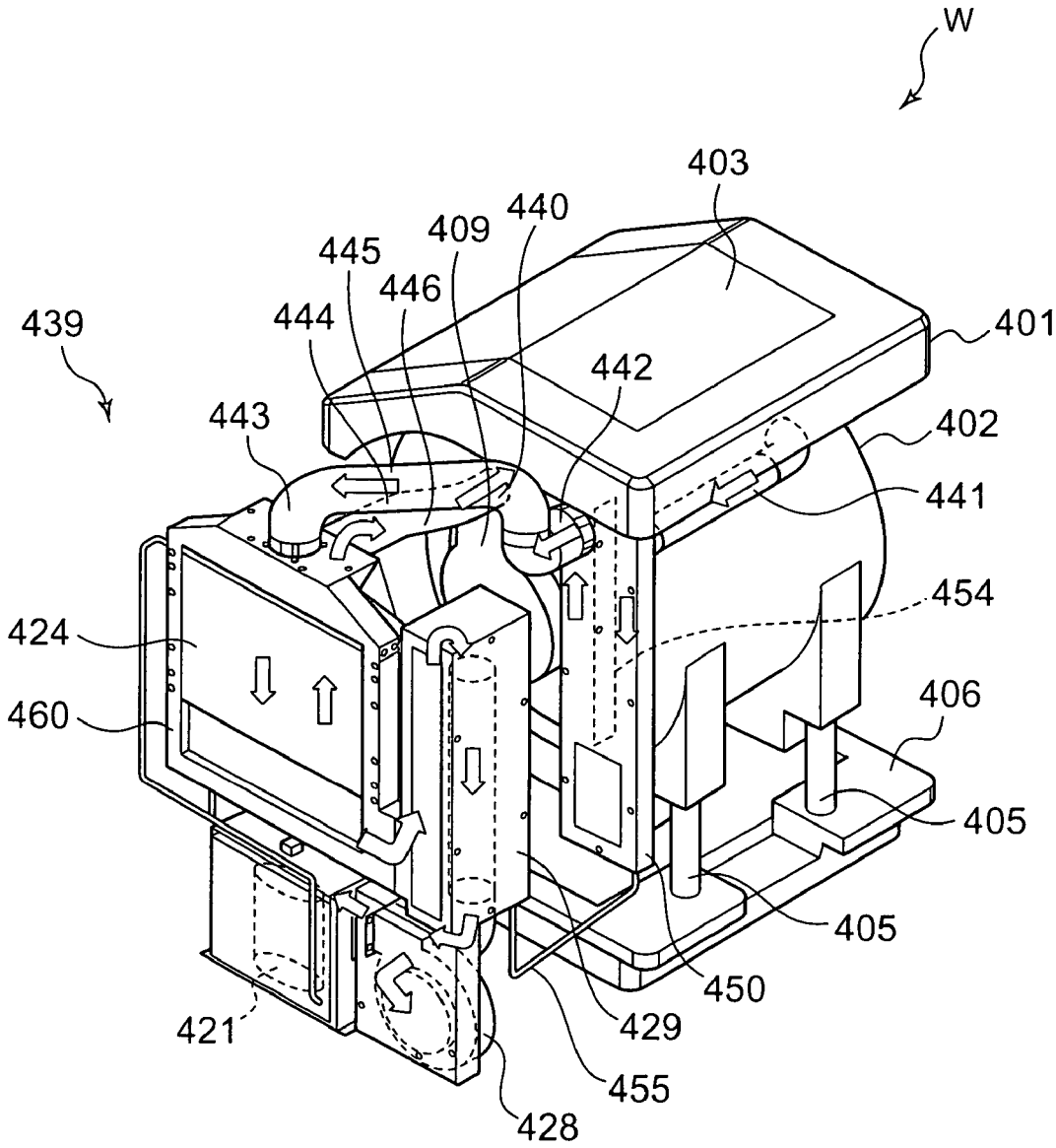
FIG. 6 is an inner constitution diagram of the washing/drying apparatus of FIG. 5 seen obliquely from behind.
Figure 7:
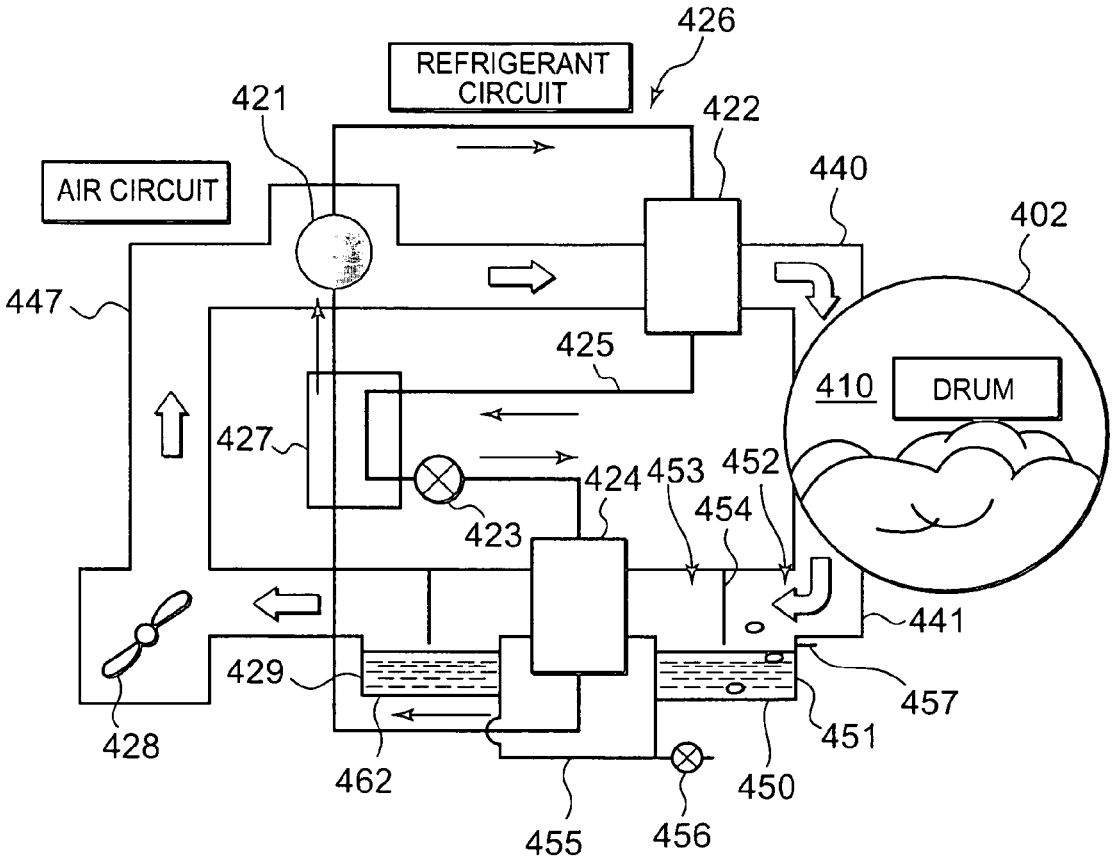
FIG. 7 is a circuit diagram showing a refrigerant circuit and an air circulation path constituting a heat pump unit of the washing/drying apparatus of FIG. 5.

Next, a washing/drying apparatus W for executing a washing operation and a drying operation after end of the washing operation will be described according to another embodiment of the drying apparatus of the present invention with reference to FIGS. 5 to 7. FIG. 5 is an inner constitution diagram of the washing/drying apparatus W in this case as viewed obliquely from a front side, FIG. 6 is an inner constitution diagram of the washing/drying apparatus W viewed obliquely from behind, and FIG. 7 is a circuit diagram showing a refrigerant circuit 426 and an air circulation path constituting a heat pump unit 439.

The washing/drying apparatus W washes and dries laundry such as clothing (the laundry turns to laundry to be dried in a drying operation). The washing/drying apparatus W in the present embodiment is constituted of a main body 401 and a heat pump unit 439. An opening/closing door 403 for inserting/removing the laundry is attached to the upper surface of the main body 401 (FIGS. 5 and 6 show an inside of an outer case of the washing/drying apparatus W), and an operation panel (not shown) in which various operation switches and a display portion are disposed is disposed on the upper surface of the main body 401 positioned beside the opening/closing door 403.

An outer drum 402 formed into a cylindrical shape by a resin and capable of storing water therein is disposed in the main body 401, and the outer drum 402 is disposed with respect to an axis of a cylinder which is a right/left direction. Moreover, a stainless steel inner drum (not shown) which serves both as a washing tank and a spin-drying tank and which is similarly formed into the cylindrical shape is disposed inside the outer drum 402 with respect to an axis of a cylinder as a right/left direction. The inside of the inner drum is constituted as an accommodating chamber 410 in which laundry is accommodated. Moreover, the axis of the cylinder of the inner drum is connected to a shaft 408 of a driving motor (not shown) attached to a side wall (positioned on an inner side of FIGS. 5 and 6) of the outer drum 402, and the inner drum is held rotatably in the outer drum 402 centering on the shaft 408. Moreover, since the outer drum 402 causes vibration/displacement by rotation of the inner drum, the outer drum is fixed onto a base 406 positioned on the bottom surface of the main body 401 via a suspension 405 having a vibration absorbing function in order to reduce vibrations/noises.

A watertight opening/closing lid (not shown) for inserting/removing the laundry is disposed corresponding to the opening/closing door 403 of the main body 401 in an upper part of the outer drum 402. A large number of through-holes (not shown) via which air and water can circulate are formed in a whole peripheral wall of the inner drum. Moreover, a stopping position of the inner drum is defined beforehand, and the opening/closing lid for inserting/removing the laundry is disposed in a position (upper surface) corresponding to the opening/closing door of the outer drum 402 at the time of stopping.

The driving motor is a motor for rotating the inner drum centering on the shaft 408 extending in the right/left horizontal direction in a washing operation and a drying operation after the end of the washing operation. The driving motor is attached to one end (inner side of FIGS. 5 and 6) of the shaft 408, and is controlled by a control device (not shown) in such a manner as to rotate the inner drum at a low speed at the time of the drying operation as compared with the washing operation.

On the other hand, a hollow portion 409 whose inner portion is formed to be hollow is formed in the other end (front side of FIGS. 5 and 6) of the shaft 8, and the hollow portion 409 is connected to a duct member 440 on a discharge side, which communicates with the inside of the inner drum (accommodating chamber 410) via the hollow portion 409.

A water supply passage (not shown) (water supply means) for supplying water into the inner drum is disposed in the upper part of the main body 401, and one end of the water supply passage is similarly connected to a water source such as tap water via a water supply valve (not shown). The water supply valve is controlled to open/close by the control device. The other end of the water supply passage is connected to the outer drum 402 to communicate with the inside of the drum, and is constituted in such a manner that water (tap water) is supplied to the accommodating chamber 410 in the inner drum from the water source, when the water supply valve is opened by the control device.

A draining passage (not shown) (draining means) for discharging the water of the accommodating chamber 410 in the inner drum 5 is disposed in a lower part of the main body 401, and one end of the draining passage communicates with a bottommost portion of the outer drum 402 via a draining valve (not shown) (also constituting the draining means) which is controlled to open/close by the control device. The other end of the draining passage is derived to the outside of the washing/drying apparatus W, and extends to a drain ditch or the like.

On the other hand, the outer drum 402 of the main body 401 is connected to a duct member 441 on a suction side, which communicates with the inside of the inner drum (accommodating chamber 410), and the other end of the duct member 441 on the suction side is connected to an inlet side of a waste thread removing device (waste thread removing means) 450. An outlet side of the waste thread removing device 450 is connected to a duct member 442.

Here, a constitution of the waste thread removing device 450 will be described with reference to FIG. 7. The waste thread removing device 450 is constituted of a tank 451 in which water is stored. In an upper part of the tank 451, a guide port 452 for introducing the air passed through the accommodating chamber 410 via the duct member 441 on the suction side, and an outflow port 453 for allowing the air introduced inside to flow out via the duct member 442 are formed. Moreover, a partition wall 454 which partitions the inside of the tank 451 into a guide port 452 side and an outflow port 453 side is formed in the upper part of the tank 451. Here, the partition wall 454 is formed in such a manner as to extend downward to a position above and apart from a water surface in the tank 451 from the upper part of the tank 451.

Furthermore, a water supply piping 455 whose one end is connected to a drain tank 429 described later is connected to the bottom surface of the tank 451, and water is supplied into the tank 451 from the drain tank 429 described later in detail. It is to be noted that the water supply piping 455 is connected to an electromagnetic opening/closing valve (draining means) 456 (shown only in FIG. 7) which is controlled to open/close by the control device. A piping 457 for overflowing is disposed in a predetermined height of the tank 451 in order to maintain a water level in the tank 451 at a predetermined height, that is, a height apart from a lower end of the partition wall 454 by a predetermined dimension.

Next, the heat pump unit 439 will be described. The heat pump unit 439 is disposed on a discharge side of drying air of the main body 401, for example, on the right side in the present embodiment. The unit includes: the refrigerant circuit 426 constituted by successively connecting a compressor 421, a radiator (heating means) 422, an expansion valve 423 which is a decompression device, and an evaporator (cooling means) 424 in an annular form via a piping 425 (shown by a bold line in FIG. 7); an inner heat exchanger 427 for exchanging heat of a refrigerant sent from the evaporator 424 with that of a refrigerant sent from the radiator 422; a blower (blower means) 428; and a drain tank 429.

A predetermined amount of carbon dioxide ($CO_2$) is sealed as a refrigerant in the refrigerant circuit 426. Here, the compressor 421 for use in the present embodiment is a rotary compressor of an inner intermediate pressure type multistage compression system, and an electromotive element, and a first rotary compression element (first stage) and a second rotary compression element (second stage) driven by the electromotive element are disposed in an airtight container (not shown).

A low-pressure refrigerant is introduced into the first rotary compression element of the compressor 421 from a refrigerant guide pipe, and a high-temperature/pressure refrigerant compressed by the second rotary compression element is discharged to the outside of the compressor 421 from a refrigerant discharge pipe.

The refrigerant discharge pipe of the compressor 421 of the refrigerant circuit 426 is connected to the inlet of the radiator 422 for heating the air. The piping 425 extending from the gas cooler 422 reaches the inlet of the expansion valve 423. The piping 425 extending out of the expansion valve 423 reaches the inlet of the evaporator 424, and the piping 425 extending out of the evaporator 424 is connected to the refrigerant guide tube to reach the compressor 421. An operation of the compressor 421, and the expansion valve 423 are controlled by the control device.

It is to be noted that the above-described control device is control means for controlling the washing/drying apparatus W, and controls operating of the driving motor (not shown), opening/closing of the water supply valve of the water supply passage, opening/closing of the draining valve of the draining passage, operating of the compressor 421, throttle adjusting of the expansion valve 423, and an air amount of the blower 428. Furthermore, the control device also controls the temperature of the air passed through the radiator 422 in order to prevent the laundry accommodated in the inner drum from being discolored or damaged.

Moreover, in the present embodiment, the compressor 421 is disposed in a side lower part of the heat pump unit 439, and a compressor cover 421A for covering the compressor 421 is disposed. The compressor cover 421A also serves as an air duct, and the compressor 421 is cooled by the air circulating in the air duct. Therefore, a disadvantage by overheating of the compressor 421 is eliminated, and safety can be improved. The blower 428 is disposed behind the compressor 421, and the blower 428 is covered with a fan case 428A.

Furthermore, a duct box 460 in which the radiator 422 and the evaporator 424 are disposed is laid above the compressor 421. In the duct box 460, the inside of the duct box 460 is divided into left and right parts (main body 401 side and outer side) by an insulating partition member (not shown). Accordingly, in the duct box 460, an outer side air passage extending downwards from above on the outer side, and a main body side air passage extending upwards from below in the main body 401 side are formed. Moreover, the evaporator 424 of the refrigerant circuit 426 is disposed in the outer side air passage, and the radiator 422 of the refrigerant circuit 426 is disposed in the main body side air passage. It is to be noted that the outer side air passage in which the evaporator 424 is disposed is constituted in such a manner that the air flows downwards from above, and therefore this constitution promotes drainage of dew condensation water generated by the evaporator 424. On the other hand, the main body side air passage in which the radiator 422 is disposed is constituted in such a manner that the air flows upwards from below. Therefore, in combination with characteristics that the air warmed by the radiator 422 rises, the air in the main body side air passage can be smoothly circulated.

Moreover, the upper part of the main body side air passage of the duct box 460 is connected to a duct member 444 on a discharge side, and the duct member 444 is detachably connected to the duct member 440 on the discharge side, disposed in the main body 401, via a flexible piping 446. On the other hand, the upper part of the outer side air passage of the duct box 460 is connected to a duct member 443 on a suction side, and the duct member 443 is detachably connected to the duct member 442 connected to the waste thread removing device 450 disposed in the main body 401 via a flexible piping 445. Accordingly, the outer side air passage of the duct box 460 is connected to an outlet side of the waste thread removing device 450.

Moreover, a lower part of the outer side air passage of the duct box 460 is formed to communicate with the drain tank 429. Accordingly, the air flowing downwards in the outer side air passage and the dew condensation water generated by the evaporator 424 flow into the drain tank 429. It is to be noted that the dew condensation water which has flown into the drain tank 429 is stored once in the drain tank 429, and then flows out into the tank 451 of the waste thread removing device 450 by the water supply piping 455 connected to the bottom surface of the drain tank 429.

Moreover, the outlet side of the drain tank 429 is connected to a duct member (not shown) connected to the blower 428 on the suction side. Here, the blower 428 draws in the air supplied from the drain tank 429, and discharges the air toward the front compressor 421. Moreover, since the compressor 421 is provided with the compressor cover 421A to cover an outer peripheral wall thereof as described above, the air discharged to the compressor 421 by the blower 428 flows into the main body side air passage of the duct box 460 disposed above.

Accordingly, a series of air circulating path 447 is constituted by the blower 428, the inside of the compressor cover 421A, the main body side air passage of the duct box 460, the duct member 444 on the discharge side, the flexible piping 446, the duct member 440 on the discharge side, the inner drum, the duct member 441 on the suction side, the waste thread removing device 450, the duct member 442, the flexible piping 445, the duct member 443 on the suction side, the outer side air passage of the duct box 460, and the drain tank 429.

Next, an operation of the washing/drying apparatus W constituted as described above will be described. Laundry and a predetermined amount of washing powder corresponding to an amount of the laundry are thrown into the accommodating chamber 410 in the inner drum. When a power switch and a start switch are operated among the above-described operation switches, the control device starts a washing operation. Moreover, the control device opens the water supply valve of the water supply passage (not shown) to open the water supply passage. Accordingly, water is supplied into the accommodating chamber 410 of the inner drum from the water source. It is to be noted that the draining valve of the draining passage is closed by the control device. When a predetermined amount of water is stored in the accommodating chamber 410 in the inner drum, the control device closes the water supply valve to close the water supply passage. Accordingly, water supply from the water source is stopped.

Next, the driving motor formed in the side surface of the main body 401 is energized/started by the control device 110 to rotate the shaft 408, accordingly the inner drum attached to the shaft 408 starts rotating in the outer drum 402, and a washing process of the washing operation is started. When a predetermined time elapses from the start of the washing process, the driving motor is stopped by the control device, and the draining valve of the draining passage is opened to discharge the water (washing water) in the accommodating chamber 410 (i.e., the outer drum 402) of the inner drum. Moreover, when the water in the accommodating chamber 410 of the inner drum is discharged, the control device operates the driving motor again to spin-dry the laundry. After performing the spin-drying for a predetermined time, the control device closes the draining valve of the draining passage.

Next, the control device shifts to a rinsing process, and opens the water supply valve of the water supply passage to open the water supply passage. Accordingly, the water is supplied to the accommodating chamber 410 in the inner drum from the water source again. When a predetermined amount of water is supplied to the accommodating chamber 410 in the inner drum, the control device closes the water supply valve to close the water supply passage. Accordingly, the water supply from the water source is stopped.

Moreover, after a rotation operation of the driving motor is repeated for a predetermined time to perform the rinsing, the control device stops the driving motor, and opens the draining valve of the draining passage to discharge the rinsing water in the accommodating chamber 410 to the draining passage. When the rinsing water in the accommodating chamber 410 is discharged, the control device operates the driving motor again, rotates the inner drum in the same manner as described above, and shifts to a spin-drying process to spin-dry the laundry.

Moreover, halfway in the spin-drying process, the control device starts the compressor 421, and starts the operation of the blower 428. After executing the spin-drying process for a predetermined time, the control device closes the draining valve, and rotates the inner drum by the driving motor to shift to a drying operation. In the drying operation, a high-temperature/pressure refrigerant gas discharged from the compressor 421 radiates heat in the radiator 422, is decompressed by the expansion valve 423, flows into the evaporator 424 to absorbs the heat from its periphery, evaporates, and is drawn in the first rotary compression element of the compressor 421 via the refrigerant guide tube. This circulation is performed.

By the operation of the blower 428, the air discharged from the blower 428 passes through the compressor 421, is preheated by the heat radiated from the compressor 421, thereafter flows into the main body side air passage of the duct box 460, exchanges the heat with the radiator 422 disposed in the main body side air passage, and is heated at the high temperature. The air flowing upwards at the high temperature in the main body side air passage is discharged into the accommodating chamber 410 in the inner drum via the duct member 444 on the discharge side, the flexible piping 446, the duct member 440 on the discharge side, and the hollow portion 409 which constitute the air circulating path 447.

The heating air discharged into the accommodating chamber 410 warms the laundry accommodated in the inner drum (accommodating chamber 410) to evaporate the moisture, and dries the laundry. The moisture-containing air which has dried the laundry flows out of the inner drum from through-holes (not shown) via the accommodating chamber 410, and is blown in the waste thread removing device 450 via the duct member 441 on the suction side constituting the air circulating path 447.

Here, it is assumed that the dew condensation water generated from the evaporator 424 and stored in the drain tank 429 is supplied into the tank 451 constituting the waste thread removing device 450 via the water supply piping 455 beforehand. It is to be noted that in a case where sufficient water (dew condensation water) is not supplied into the tank 451 in an initial stage of the operation start, tap water is supplied and the water is stored at a certain level in the tank 451.

Moreover, the high-temperature humid air blown in the waste thread removing device 450 is sprayed to the water stored in the tank 451. At this time, the air blown into the waste thread removing device 450 includes waste thread generated at the time of the drying of laundry to be dried such as clothing in the accommodating chamber 410. However, when the air is sprayed to the water in the tank 451, it is possible to recover a floating matter only such as waste thread in the air into the water in a simple constitution. Moreover, at this time, the waste thread is removed, when the air is sprayed to the water. Therefore, the waste thread can be removed without lowering wind velocity of the circulating air to the utmost. Therefore, the influence on a drying capability can be reduced. It is to be noted that in the present embodiment, since the partition wall 454 is disposed in the upper part of the tank 451, a disadvantage of a short circle can be avoided without spraying any air to the water.

Here, since the air is sprayed into the tank 451 at the high temperature, evaporation of water stored in the tank 451 is promoted, but dew condensation water generated in the evaporator 424 is used in the water to be supplied into the tank 451, and therefore the water can be sufficiently supplied into the tank 451. Therefore, the water in the tank 451 completely evaporates, and a disadvantage that the waste thread recovered on wall surfaces adheres can be avoided. Moreover, since the tap water is especially used only at the start of the operation in the constitution, water charges can be saved as compared with a case where the tap water is supplied at any time. Furthermore, in the present embodiment, the dew condensation water from the evaporator 424, which is usually discarded, can be effectively used. It is to be noted that a pump which is not used in the present embodiment may be disposed in the water supply piping 455, and the dew condensation water in the drain tank 429 may be positively conveyed into the tank 451. Even when the level of the water stored in the tank 451 exceeds a predetermined water level by the dew condensation water supplied from the drain tank 429, overflowing water can be smoothly discharged by the piping 457 for overflowing in the constitution. Therefore, a disadvantage that the air passage in the tank 451 is completely closed by the water can be avoided.

Moreover, the high-temperature humid air from which a floating matter such as waste thread has been removed by the waste thread removing device 450 is drawn in the outer side air passage of the duct box 460 in which the evaporator 424 is disposed via the duct member 442, flexible piping 445, and duct member 443 on the suction side, constituting the air circulating path 447. In the outer side air passage, a water content contained in the air from the accommodating chamber 410 (water content evaporated from the laundry) is condensed on the surface of the evaporator 424 in the process of passing through the evaporator 424, and falls as water drops. The water drops which have fallen are once stored in the drain tank 429, and is thereafter fed into the tank 451 of the waste thread removing device 450 via the water supply piping 455 as described above.

Moreover, after completely recovering the dew condensation water in the drain tank 429, the dried air from which the moisture has been removed by the evaporator 424 is drawn in the blower 428, and discharged into the compressor 421. Here, the compressor 421 is at the high temperature by the operation. Accordingly, after the air discharged into the compressor 421 is heated by the compressor 421, the air flows into the main body side air passage of the duct box 460 disposed above the compressor 421. Since the radiator 422 is disposed in the main body side air passage, the air moving upwards in the main body side air passage is further heated, and thereafter discharged into the accommodating chamber 410 in the inner drum via the duct member 444 on the discharge side, flexible piping 446, and duct member 440 on the discharge side, constituting the air circulating path 447. The moisture is removed from the laundry in the accommodating chamber 410 to dry the laundry. This circulation is repeated. When the drying operation is performed by the control device for a predetermined time, the laundry in the accommodating chamber 410 in the inner drum is completely dried.

As described above in detail, the waste thread or the like floating in the air circulating in the air circulating path 447 can be captured by the water and removed by the waste thread removing device 450, and a disadvantage that the waste thread is deposited in the air circulating path 447 can be eliminated. Therefore, the waste thread can be inhibited from being attached to the evaporator 424 or the radiator 422 in which the waste thread is easily deposited, and therefore the occurrence of the clogging of the evaporator 424, radiator 422 or the like can be avoided.

Moreover, since the waste thread removing device 450 is constituted to remove the waste thread without using any filter, maintenance works such as replacing and cleaning of the filter are not required, and convenience can be improved. Since the dew condensation water generated in the evaporator 424 is used in the water for use in the waste thread removing device 450 as described above, the water for removing the waste thread does not have to be separately replenished.

It is to be noted that the waste thread captured in the tank 451 of the waste thread removing device 450 is discarded to the outside together with the water stored in the tank 451, when the electromagnetic opening/closing valve 456 is opened by the control device at the end of the operation of the washing/drying apparatus W.

In the embodiment, the laundry to be dried accommodated in the accommodating chamber 410 as described above is heated by the high-temperature drying air heated by the radiator 422, and the moisture evaporated from the laundry to be dried can be condensed in the evaporator 424 and discarded. Therefore, a time required for the drying is effectively shortened, and an energy efficiency can be largely raised. Since the moisture to be discharged does not have to be discarded to the outside of the accommodating chamber 410, an environment of a room in which the washing/drying apparatus W is installed is not deteriorated, and an equipment cost for improving the environment in the room can be eliminated.

Moreover, in the embodiment, a refrigerant such as carbon dioxide is used as described above in such a manner as to achieve a supercritical pressure on a high pressure side of a refrigerant circuit, and therefore the temperature of the radiator 422 can be raised. Accordingly, the temperature of the drying air circulated in the accommodating chamber 410 can be maintained to be high, the laundry to be dried accommodated in the accommodating chamber 410 is dried in a shorter time, and energy consumption for use in the drying can further be saved.

Moreover, in the present embodiment, the rotary compressor of the inner intermediate pressure type multistage (two stages) compression type including the first and second rotary compression elements is used, but the compressor usable in the present invention is not limited to this compressor.

Furthermore, the radiator 422 and evaporator 424 constituting the refrigerant circuit are used as heating and cooling means in the present embodiment, but the heating and cooling means are not limited to them. The heating and cooling means constituted of any means produce a similar effect as long as the dew condensation water is generated in the cooling means.

Figure 8:
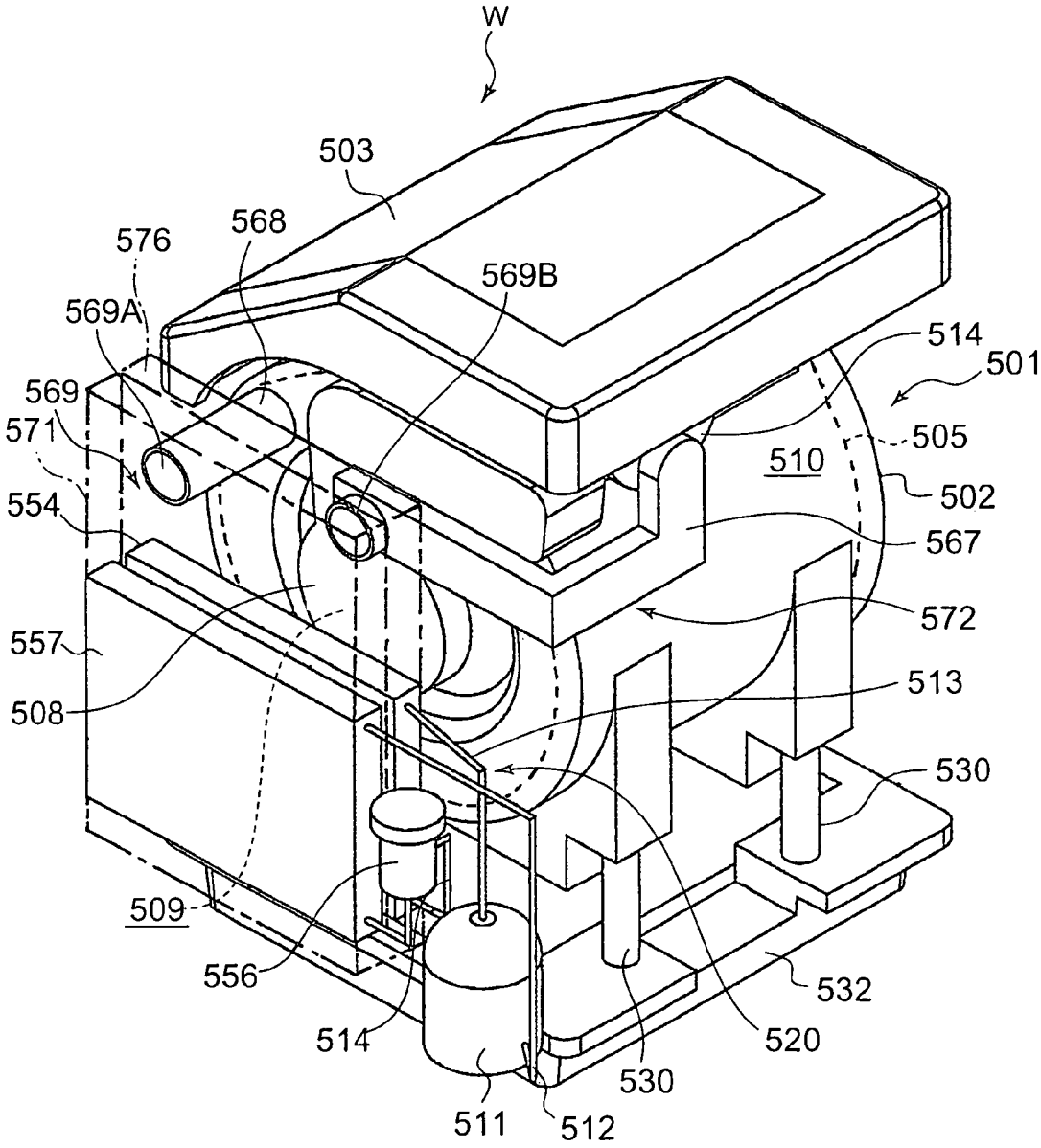
FIG. 8 is a perspective view showing an inner constitution of the washing/drying apparatus which is still another embodiment of the drying apparatus of the present invention.
Figure 9:
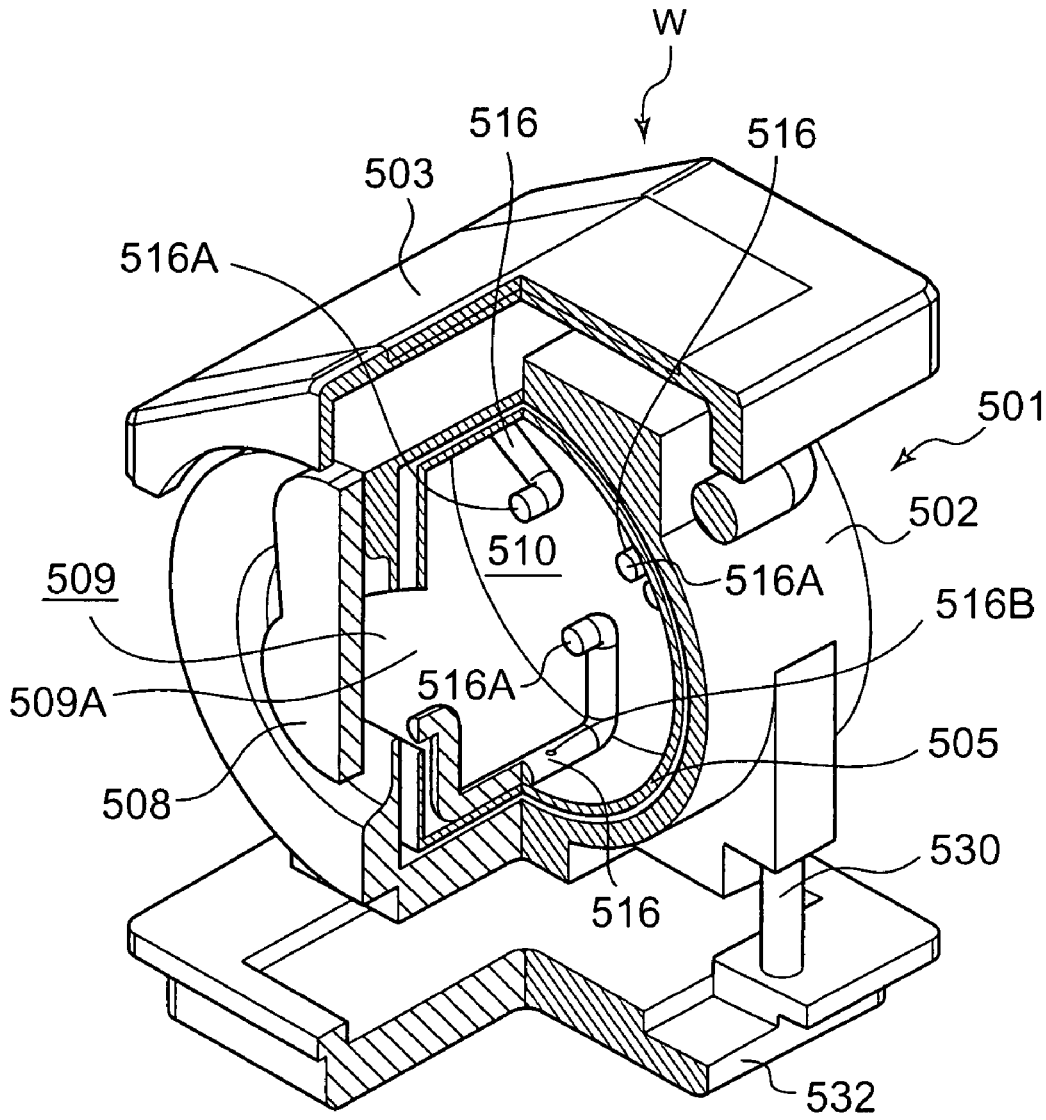
FIG. 9 is a partially cut perspective view of FIG. 8.
Figure 10:
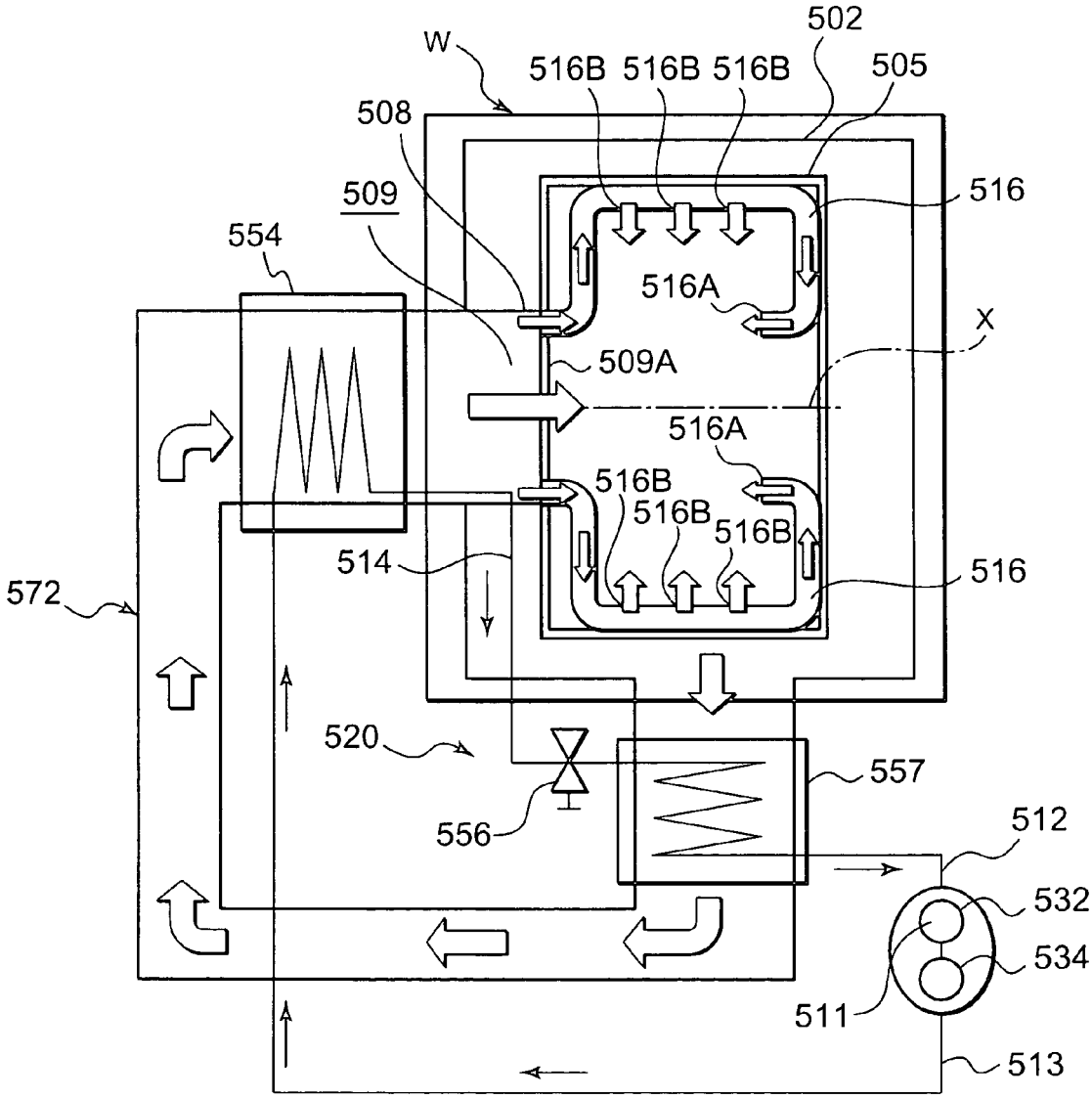
FIG. 10 is a diagram showing a refrigerant and a flow of air of the washing/drying apparatus of FIG. 8.

Next, still another embodiment of the drying apparatus of the present invention will be described in detail with reference to FIGS. 8 to 10. FIG. 8 is an inner constitution diagram of a washing/drying apparatus W for executing a washing operation and a drying operation after end of the washing operation according to the embodiment of the drying apparatus in this case, FIG. 9 is a partially cut inner constitution diagram of the machine, and FIG. 10 is a diagram showing flows of a refrigerant and drying air of the washing/drying apparatus W.

The washing/drying apparatus W of the present embodiment is used for washing and drying laundry such as clothing (the laundry turns to laundry to be dried in a drying operation). An opening/closing door 503 for inserting/removing the laundry is attached to a middle portion of the upper surface of a main body 501 (the figures show an inside of a case of the main body 501) forming an outer structure, and an operation panel (not shown) in which various operation switches and a display portion are disposed is disposed on the upper surface of the main body 501 positioned beside the opening/closing door 503.

An outer drum 502 capable of storing water therein and formed into a cylindrical shape by a resin is disposed in the main body 501, and the outer drum 502 is disposed with respect to an axis of a cylinder which is a right/left direction. Moreover, a cylindrical stainless steel inner drum (rotating drum in the present invention) 505 which serves both as a washing tank and a spin-drying tank is disposed inside the outer drum 502. The inside of the inner drum 505 is constituted as an accommodating chamber (functioning as an accommodating chamber in the drying operation) 510 in which laundry is accommodated. The inner drum is also disposed with respect to the axis of the cylinder (rotation axis shown by X in FIG. 10) which is the right/left direction. Moreover, the rotation axis X is connected to a shaft 508 of a driving motor (not shown) attached to a side wall (an inner side of FIG. 8) of the outer drum 502, and the inner drum 505 is held rotatably in the outer drum 502 centering on the rotation axis X which is the axis of the inner drum 505 connected to the shaft 508.

Moreover, since the outer drum 502 causes vibration/displacement by the rotation of the inner drum 505, the outer drum is fixed onto a base 532 positioned on the bottom surface of the main body 501 via a suspension 530 having a vibration absorbing function in order to reduce vibrations/noises. That is, the rotary inner drum 505 is attached onto the base 532 via the outer drum 502 and the suspension 530.

A watertight opening/closing lid (not shown) for inserting/removing the laundry is disposed corresponding to the opening/closing door 503 in an upper part of the outer drum 502. A large number of through-holes (not shown) via which air and water can circulate are formed in a whole peripheral wall of the inner drum 505. Moreover, a stopping position of the inner drum 505 is defined beforehand, and the opening/closing lid for inserting/removing the laundry is disposed in a position (upper surface) corresponding to the opening/closing door of the outer drum 502 at the time of stopping.

The driving motor is a motor for rotating the inner drum 505 centering on the shaft 508 extending in the right/left horizontal direction in a washing operation and a drying operation after the end of the washing operation. The driving motor is attached to the other end (inner side of FIG. 8) of the shaft 508, and is controlled by a control device (not shown) in such a manner as to rotate the inner drum 505 at a low speed at the time of the drying operation as compared with the washing operation.

A hollow portion 509 whose inner portion is formed to be hollow is formed in one end (front side of FIG. 8) of the shaft 508, and an air circulation path 572 described later is connected to the inner drum 505 via a discharge port 509A of the hollow portion 509.

In an upper part of the main body 501, a water supply passage (not shown) which is water supply means for supplying water into the inner drum 505 is disposed, and one end of the water supply passage is connected to a water source such as tap water via a water supply valve. The water supply valve is controlled to open/close by the control device. The other end of the water supply passage is connected to the outer drum 502 to communicate with the inside of the drum. When the water supply valve is opened by the control device, the water (tap water) is supplied to an accommodating chamber 510 in the inner drum 505 disposed in the outer drum 502 from the water source.

A draining passage (not shown) which is draining means for discharging the water of the accommodating chamber 510 in the inner drum 5055 is disposed in a lower part of the main body 501, and one end of the draining passage communicates with a bottommost portion of the outer drum 502 via a draining valve which is controlled to open/close by the control device. The other end of the draining passage is derived to the outside of the washing/drying apparatus W, and extends to a drain ditch or the like.

On the other hand, the air circulation path 572 is constituted over the side of the outer drum 502 from a rear side of the drum in the main body 501. The air circulation path 572 is constituted of a duct member 567 on a discharge side, a duct member 568 on a suction side, an air passage 569 formed in a duct box 571 and the like. One end of the duct member 567 is connected/fixed onto the outer drum 502 in such a manner as to communicate with the inside of the inner drum 505 (accommodating chamber 510) via the discharge port 509A of the hollow portion 509 formed in one end (front side of FIG. 8) of the shaft 508, and the other end thereof is connected/fixed to an outlet 569B of the air passage 569 formed in the duct box 571. One end of the duct member 568 is connected/fixed to the outer drum 502 in such a manner as to communicate with the inside of the inner drum 505 (accommodating chamber 510) in the outer drum 502, and the other end thereof is connected/fixed to an inlet 569A of the air passage 569.

Here, both the duct members 567, 568 constituting the air circulation path 572 are constituted of a metal or a heat-resistant synthetic resin, and a whole or at least a part of each member is constituted of a material having flexibility, for example, a flexible hose.

Moreover, a blower 514 which is blower means is disposed in the duct member 567. The blower 514 supplies drying air in the air circulation path 572 into the accommodating chamber 510 in the inner drum 505 from the duct member 567 of the air circulation path 572 via the discharge port 509A of the hollow portion 509 of the shaft 508. That is, in the washing/drying apparatus W, the drying air in the air circulation path 572 is circulated in the inner drum 505 by the blower 514 at the time of the drying operation, and the drying air heated by heat exchange with a gas cooler 554 (radiator) disposed in the air passage 569 of the air circulation path 572 is discharged into the accommodating chamber 510 in the inner drum 505.

The air passage 569 is formed in the duct box 571 as described above. As shown in FIG. 8, the inside of the duct box 571 is divided into a front side and an inner side by an insulating partition member 576 in a state a lower part on one side communicates with that on the other side. Accordingly, a series of air passage 569 is constituted in the duct box 571 in such a detour form that the passage extends downwards from above on the front side and extends upwards from below on the inner side. Moreover, an evaporator 557 of a refrigerant circuit 520 is disposed on the front side of the air passage 569, and the gas cooler 554 of the refrigerant circuit 520 is disposed on the inner side.

It is to be noted that as described above the lower part of the gas cooler 554 is connected to that of the evaporator 557 without being partitioned by the partition member 576. Moreover, the inlet 569A of the air passage 569 opens in the upper part of the air passage 569 on the front side of the duct box 571. Accordingly, the duct member 568 communicates with the upper part of air passage 569 on the front side of the duct box 571. The outlet 569B of the air passage 569 opens in the upper part of the air passage 569 on the inner side of the duct box 571, and accordingly the duct member 567 communicates with the upper part of the air passage 569 on the inner side of the duct box 571.

According to the constitution, the air which has circulated in the accommodating chamber 510 by the operation of the blower 514 and which has dried the laundry flows into the air passage 569 on the front side of the duct box 571 from the inlet 569A via the duct member 568 of the air circulation path 572, flows downwards, exchanges the heat with the evaporator 557 disposed in the air passage 569 on the front side, and is cooled and dehumidified. The air enters the air passage 569 on the inner side of the duct box 571 from the lower side of the partition member 576, flows upwards, exchanges the heat with the gas cooler 554 disposed in the air passage 569 on the inner side, and is heated. Thereafter, the air flows out of the outlet 569B, enters the duct member 567, is drawn in the blower 514 disposed in the duct member, and is discharged into the accommodating chamber 510 from the blower 514.

Next, reference numeral 520 denotes the refrigerant circuit. The refrigerant circuit 520 is constituted by successively connecting a rotary compressor 511, the gas cooler 554, an expansion valve 556 which is a decompression device, the evaporator 557 and the like in an annular form via a piping. Moreover, the rotary compressor 511, the expansion valve 556, and the duct box 571 including therein the gas cooler 554 and evaporator 557 are attached and fixed to the base 532. Moreover, a predetermined amount of carbon dioxide ($CO_2$) is sealed as the refrigerant in the refrigerant circuit 520.

The rotary compressor 511 of the present embodiment is a rotary compressor of an inner intermediate pressure type two-stage compression system in which an electromotive element, and a first rotary compression element 532 and a second rotary compression element 534 driven by the electromotive element are disposed in an airtight container. Moreover, a low-pressure refrigerant is introduced into the first rotary compression element 532 of the compressor 511 from a refrigerant guide pipe 512, and a high-temperature/pressure refrigerant compressed by the second rotary compression element 534 is discharged to the outside of the compressor 511 from a refrigerant discharge pipe 513.

The refrigerant discharge pipe 513 of the compressor 511 of the refrigerant circuit 520 is connected to the inlet of the gas cooler 554 for heating the air. A piping extending out of the gas cooler 554 is connected to the inlet of the expansion valve 556. The piping extending out of the expansion valve 556 reaches the inlet of the evaporator 557, and the piping extending out of the evaporator 557 is connected to the refrigerant guide pipe 35120 to reach the compressor 511. The operation of the rotary compressor 511 and the expansion valve 556 are controlled by the control device.

It is to be noted that the above-described control device is control means for controlling the washing/drying apparatus W, and controls operating of the driving motor (not shown), opening/closing of the water supply valve of the water supply passage, opening/closing of the draining valve of the draining passage, operating of the compressor 511, throttle adjusting of the expansion valve 556, and an air amount of the blower 514. Furthermore, the control device also controls the temperature of the drying air passed through the gas cooler 554 in order to prevent the laundry accommodated in the inner drum 505 from being discolored or damaged.

On the other hand, duct members 516 constituted of metal pipes or heat-resistant resin pipes are attached to three places on an inner wall of the inner drum 505. One end of each of the duct members 516 . . . is positioned in the hollow portion 509, and opens on an upstream side of the drying air entering the hollow portion 509 of the shaft 508 from the duct member 567. The duct members 516 . . . extend to the other side of the rotation axis X along the inner wall of the inner drum 505, and discharge ports 516A opening toward the hollow portion 509 are formed in the other ends. In this state, the duct members 516 . . . protrude in the accommodating chamber 510 on the inner wall of the inner drum 505, and a plurality of discharge ports 516B are formed in the side surface of each duct member 516 between one end and the other end of the member.

Accordingly, the discharge port 509A opens in the accommodating chamber 510 on one side of the rotation axis X of the inner drum 505, and the discharge ports 516A . . . open in the accommodating chamber 510 on the other side of the rotation axis X. The discharge ports 516B . . . are positioned in a peripheral surface of the inner drum 505 to open in the accommodating chamber 510.

Next, an operation of the washing/drying apparatus W in this case constituted as described above will be described. Laundry and a predetermined amount of washing powder corresponding to an amount of the laundry are thrown into the accommodating chamber 510 in the inner drum 505. When a power switch and a start switch are operated among the above-described operation switches, the control device starts a washing operation. Moreover, the control device opens the water supply valve of the water supply passage (not shown) to open the water supply passage. Accordingly, water is supplied into the accommodating chamber 510 of the inner drum 505 in the outer drum 502 from the water source. It is to be noted that the draining valve of the draining passage at this time is closed by the control device.

When a predetermined amount of water is stored in the accommodating chamber 510 in the inner drum 505, the control device closes the water supply valve to close the water supply passage. Accordingly, water supply from the water source is stopped.

Next, the driving motor formed in the side surface of the main body 501 is energized/started by the control device 110 to rotate the shaft 508, accordingly the inner drum 505 attached to the shaft 508 starts rotating in the outer drum 502, and a washing process of the washing operation is started. In this case, since the duct members 516 protrude from the inner wall of the inner drum 505, the members perform a function of stirring the laundry to promote removal of dirt.

When a predetermined time elapses from the start of the washing process, the driving motor is stopped by the control device, and the draining valve of the draining passage is opened to discharge the water (washing water) in the accommodating chamber 510 (i.e., the inside of the outer drum 502) of the inner drum 505.

Moreover, when the water in the accommodating chamber 510 of the inner drum 505 is discharged, the control device operates the driving motor again to spin-dry the laundry. After performing the spin-drying for a predetermined time, the control device closes the draining valve of the draining passage.

Next, the control device shifts to a rinsing process, and opens the water supply valve of the water supply passage to open the water supply passage. Accordingly, the water is supplied to the accommodating chamber 510 in the inner drum 505 from the water source again. When a predetermined amount of water is supplied to the accommodating chamber 510 in the inner drum 505, the control device closes the water supply valve to close the water supply passage. Accordingly, the water supply from the water source is stopped.

Moreover, after a rotation operation of the driving motor is repeated for a predetermined time to perform the rinsing, the control device stops the driving motor, and opens the draining valve of the draining passage to discharge the rinsing water in the accommodating chamber 510 to the draining passage. When the rinsing water in the accommodating chamber 510 is discharged, the control device operates the driving motor again, rotates the inner drum 505 in the same manner as described above, and shifts to a spin-drying process to spin-dry the laundry.

After executing the spin-drying process for a predetermined time, the control device closes the draining valve. The control device starts the rotary compressor 511, and also starts the operation of the blower 514. Moreover, the device rotates the inner drum 505 by the driving motor to shift to a drying operation.

In the drying operation, a high-temperature/pressure gas refrigerant discharged from the second rotary compression element 534 of the rotary compressor 511 radiates heat in the gas cooler 554, and thereafter reaches the expansion valve 556. Here, the refrigerant is not condensed, and the refrigerant circuit 520 has a supercritical pressure on a high-temperature side. The refrigerant which has reached the expansion valve 556 is decompressed therein, is liquefied in the process, next flows into the evaporator 557 to absorbs the heat from its periphery, evaporates, and is drawn in the first rotary compression element 532 of the rotary compressor 511 via the refrigerant guide tube 512. This circulation is performed.

By the operation of the blower 514, the drying air heated at the high temperature by the heat radiation of the high-temperature/pressure refrigerant in the gas cooler 554 flows out of the duct member 567 of the air circulation path 572 to flow into the hollow portion 509. A part of the drying air which has flown into the hollow portion 509 is discharged into the accommodating chamber 510 from the discharge port 509A (the drying air is discharged from one side of the rotation axis X). The remaining drying air which has flown into the hollow portion 509 flows into the duct members 516 . . . from one-end opening of each of the duct members 516 . . . The high-temperature drying air which has flown into the duct members 516 . . . passes through the members, and is discharged into the accommodating chamber 510 from the discharge ports 516A . . . in the other end (the drying air is discharged from the other side of the rotation axis X). The drying air passed through the duct members 516 . . . is discharged into the accommodating chamber 510 also from the discharge ports 516B in the side surface (discharge of the drying air from a peripheral direction of the inner drum 505).

In this case, since the temperatures of the duct members 516 . . . rise, the temperature of the inner drum 505 also rises by heat transfer. The drying air discharged from a plurality of places is uniformly sprayed to the laundry to be dried (laundry) in the accommodating chamber 510, and the temperature rise of the inner drum 505 is also promoted.

Moreover, in this case, since the duct members 516 protrude into the accommodating chamber 510 of the inner drum 505, an operation (tumbling) for lifting up and dropping down the laundry to be dried is performed with the rotation of the inner drum 505 to stir the laundry to be dried.

The heating air discharged into the accommodating chamber 510 in this manner warms the laundry accommodated in the inner drum 505 (accommodating chamber 510) to evaporate the moisture, and dries the laundry to be dried. The moisture-containing air which has dried the laundry to be dried flows out of the inner drum 505 from through-holes (not shown) via the accommodating chamber 510, passes through the duct member 568 of the air circulation path 572, is blown in the air passage 569 via the inlet 569A, and is introduced into and passed through the evaporator 557 disposed in the passage.

A water content (water content evaporated from the laundry to be dried) contained in the air from the accommodating chamber 510 is condensed on the surface of the evaporator 557 in the process of passing through the evaporator 557, and falls as water drops. The water drops which have fallen are discharged into an outer drain ditch or the like from the draining passage via a drain pipe (not shown).

The dried air from which the moisture has been removed by the evaporator 557 next flows into the gas cooler 554, and is heated. Moreover, the air flows out of the outlet 569B of the air passage 569 to enter the duct member 567, is drawn in the blower 514, blown in the hollow portion 509 of the shaft 508, and discharged into the accommodating chamber 510 in the inner drum 505 in the same manner as described above to remove the moisture from the laundry to be dried and to dry the laundry. This circulation is repeated.

When the drying operation is executed for a predetermined time by the control device, the laundry to be dried in the accommodating chamber 510 in the inner drum 505 is completely dried. When the air in the air circulation path 572 is heated by the gas cooler 554, and dehumidified by the evaporator 557, the laundry to be dried can be efficiently dried. When a refrigerant such as carbon dioxide is used in such a manner as to achieve a supercritical pressure on the high pressure side of the refrigerant circuit, a large heating capability can be obtained in the gas cooler 554.

Especially, since the discharge ports 509A, 516A for discharging the drying air are formed on the opposite sides of the rotation axis X of the inner drum 505, the laundry to be dried contacts the drying air well as compared with a case where the drying air is discharged into the accommodating chamber 510 from one direction, and uniform drying and reducing of a drying time can be realized. Especially, since the drying air is discharged into the accommodating chamber 510 from the opposite sides of the rotation axis X of the inner drum 505, the discharge ports 509A, 516A are not easily closed by the laundry to be dried, and the drying air is smoothly passed.

Moreover, since the duct members 516 are protruded from the inner wall of the inner drum 505 to guide the drying air into the discharge ports 516A on the other side from one side of the rotation axis X of the inner drum 505, the drying air can be guided and discharged from the discharge ports 516A on the other side with a simple structure. Moreover, since the temperature of the inner drum 505 itself rises via the duct members 516 . . . , a drying performance is further improved. Moreover, since the duct members 516 . . . protrude from the inner wall of the inner drum 505, the laundry to be dried in the accommodating chamber 510 is tumbled by the duct members 516 . . . , and the reducing of the drying time and the uniform drying can be further promoted.

Furthermore, since the discharge ports 516B . . . are formed in the side surfaces of the duct members 516 . . . , the drying air can be discharged into the accommodating chamber 510 from the side surfaces of the duct members 516. Accordingly, the drying air is further sprayed to the laundry to be dried in the accommodating chamber 510 from multiple directions, the drying can be further uniformed, and the drying time can be reduced.

It is to be noted that also in the present embodiment, the drying air is heated and dehumidified using the refrigerant circuit, but the present invention is not limited to the embodiment, and is effective even in a drying apparatus using an electric heater or a water-cooled/air-cooled heat exchanger. Moreover, in the embodiment, the rotary compressor 511 of the inner intermediate pressure type multistage (two stages) compression system including the first and second rotary compression elements 532, 534 is used, but a compressor usable in the present invention is not limited to this rotary compressor. In the embodiment, the present invention is applied to the washing/drying apparatus having a washing/drying function, but, needless to say, the present invention may be applied to a drying apparatus which has a single drying function only.

What is claimed is:

1. A drying apparatus comprising:

an accommodating chamber in which laundry is accommodated and in which a washing operation of the laundry and a drying operation after end of the washing operation are performed;

a refrigerant circuit in which a compressor, a radiator, a decompression device, and an evaporator are successively connected to one another in an annular form via a piping;

an air path for discharging air which has exchanged heat with the radiator into the accommodating chamber by blower means to exchange the heat of the air passed through the accommodating chamber with the evaporator; and control means for operating the compressor and the blower means to perform the drying operation, wherein the control means starts the operation of the compressor before entering the drying operation.

2. A drying apparatus comprising:

an accommodating chamber in which laundry is accommodated and in which a washing operation of the laundry and a drying operation after end of the washing operation are performed;

a refrigerant circuit in which a compressor, a radiator, a decompression device, and an evaporator are successively connected to one another in an annular form via a piping;

an air path for discharging air which has exchanged heat with the radiator into the accommodating chamber by blower means to exchange the heat of the air passed through the accommodating chamber with the evaporator;

control means for operating the compressor and the blower means to perform the drying operation;

an electric heater; and power accumulation means for accumulating power to be supplied to the electric heater, wherein the control means heats the air discharged into the accommodating chamber by the electric heater at the time of the drying operation.

3. A drying apparatus comprising:

an accommodating chamber in which laundry is accommodated and in which a washing operation of the laundry and a drying operation after end of the washing operation are performed;

a refrigerant circuit in which a compressor, a radiator, a decompression device, and an evaporator are successively connected to one another in an annular form via a piping;

an air path for discharging air which has exchanged heat with the radiator into the accommodating chamber by blower means to exchange the heat of the air passed through the accommodating chamber with the evaporator;

control means for operating the compressor and the blower means to perform the drying operation;

an electric heater; and a heat storage material heated by the electric heater to store heat, wherein the control means heats the air discharged into the accommodating chamber by the heat storage material at the time of the drying operation.

4. The drying apparatus according to claim 2 or 3, wherein the control means accumulates power into the power accumulation means in a range of a power input limitation at the time of the washing operation, or heats the heat storage material by the electric heater.

5. A drying apparatus comprising:

an accommodating chamber in which laundry to be dried is accommodated and in which a drying operation of the laundry to be dried is performed;

heating means, cooling means, and blower means for discharging air which has exchanged heat with the heating means into the accommodating chamber to exchange the heat of the air passed through the accommodating chamber with the cooling means; and waste thread removing means for storing water for removing waste thread in the air discharged from the accommodating chamber, wherein:

dew condensation water attached to the cooling means is supplied to the waste thread removing means, the waste thread removing means is structured to spray the air passed through the accommodating chamber to water to be stored, and the waste thread removing means includes: a tank in which water is stored; a guide port for introducing the air passed through the accommodating chamber from an upper part of the tank; an outflow port for allowing the air to flow from the upper part of the tank; and a partition wall which is positioned between the guide port and the outflow port and which moves down to a position above and apart from the surface of the water in the tank from the upper part of the tank.

6. The drying apparatus according to claim 1, further comprising:

a refrigerant circuit in which a compressor, a radiator, a decompression device, and an evaporator are successively connected to one another in an annular form via a piping, wherein the radiator constitutes the heating means, and the evaporator constitutes the cooling means.

7. The drying apparatus according to claim 6, wherein the waste thread removing means is structured to spray the air passed through the accommodating chamber to water to be stored.

8. The drying apparatus according to claim 7, wherein the waste thread removing means includes: a tank in which water is stored; a guide port for introducing the air passed through the accommodating chamber from an upper part of the tank; an outflow port for allowing the air to flow from the upper part of the tank; and a partition wall which is positioned between the guide port and the outflow port and which moves down to a position above and apart from the surface of the water in the tank from the upper part of the tank.

9. The drying apparatus according to claim 5, 6, 7, or 8, wherein the waste thread removing means includes draining means.

10. The drying apparatus according to claim 5, 6, or 8, wherein the refrigerant circuit uses carbon dioxide as a refrigerant, and has a supercritical pressure on a high pressure side thereof.

11. A drying apparatus for supplying drying air into an accommodating chamber constituted in a rotating drum to perform a drying operation of laundry to be dried accommodated in the accommodating chamber, wherein discharge ports for discharging the drying air are formed on opposite sides of the rotating drum in a rotation axis direction.

12. The drying apparatus according to claim 11, further comprising: the discharge port formed on one side of a rotation axis of the rotating drum; a discharge port formed on the other side; and a duct member which is disposed protruding from an inner surface of the rotating drum and which guides drying air to the discharge port on the other side from one side of the rotation axis of the rotating drum.

13. The drying apparatus according to claim 12, wherein the discharge ports are formed in the duct member.

14. The drying apparatus according to claim 11, 12, or 13, further comprising:

a refrigerant circuit in which a compressor, a radiator, a decompression device, an evaporator and the like are successively connected to one another in an annular form via a piping; and blower means for discharging the drying air which has exchanged heat with the radiator into the accommodating chamber to exchange the heat of the air passed through the accommodating chamber with the evaporator.

15. The drying apparatus according to claim 14, wherein the refrigerant circuit uses carbon dioxide as a refrigerant, and has a supercritical pressure on a high pressure side thereof.

16. A drying apparatus comprising:

an accommodating chamber in which laundry to be dried is accommodated and in which a drying operation of the laundry to be dried is performed;

heating means, cooling means, and blower means for discharging air which has exchanged heat with the heating means into the accommodating chamber to exchange the heat of the air passed through the accommodating chamber with the cooling means; and waste thread removing means for storing water for removing waste thread in the air discharged from the accommodating chamber, wherein:

dew condensation water attached to the cooling means is supplied to the waste thread removing means, and the refrigerant circuit uses carbon dioxide as a refrigerant, and has a supercritical pressure on a high pressure side thereof.

17. The drying apparatus according to claim 9, wherein the refrigerant circuit uses carbon dioxide as a refrigerant, and has a supereritical pressure on a high pressure side thereof.

* * * * *